US006966825B2

(12) United States Patent
Ke

(10) Patent No.: US 6,966,825 B2
(45) Date of Patent: Nov. 22, 2005

(54) WALL/ROOF POLISHER

(76) Inventor: Ganxing Ke, No. 2, Lane 1, Pengdi Street, Nancun Town, Panyu District, Guangzhou City, Guangdong Province, 511442 (CN)

( * ) Notice: Subject to any disclaimer, the term of this patent is extended or adjusted under 35 U.S.C. 154(b) by 0 days.

(21) Appl. No.: 10/760,101

(22) Filed: Jan. 16, 2004

(65) Prior Publication Data

US 2005/0142994 A1 Jun. 30, 2005

(30) Foreign Application Priority Data

Oct. 30, 2003 (CN) ..... PCT/CN03/00918

(51) Int. Cl.[7] ..... B24B 23/00
(52) U.S. Cl. ..... 451/344; 451/119; 451/124; 51/180
(58) Field of Search ..... 451/119, 124, 150, 451/151, 154, 340, 345, 358, 361, 344; 51/180

(56) References Cited

U.S. PATENT DOCUMENTS 2,049,935 A * 8/1936 Woodward ..... 451/354
2,670,577 A * 3/1954 McDonough ..... 451/354
2,755,606 A * 7/1956 Ronvold et al. ..... 451/354
3,439,372 A * 4/1969 Collier ..... 15/53.1
3,948,005 A * 4/1976 Whitsett ..... 451/354
4,123,877 A * 11/1978 Pere ..... 451/24

FOREIGN PATENT DOCUMENTS

| | | |
|---|---|---|
| CN | 00114111 | 3/2000 |
| CN | 1396041 | 2/2003 |
| CN | 1445425 | 10/2003 |

* cited by examiner

*Primary Examiner*—Lee D. Wilson
*Assistant Examiner*—Anthony Ojini
(74) *Attorney, Agent, or Firm*—Knobbe, Martens, Olson & Bear, LLP

(57) ABSTRACT

This invention discloses a large-scale wall polisher that is operated by a single operator and applicable to polish different rooms, external walls, and ceilings and with dust absorption and positioning functions; in addition, as a complement to the large-scale machine, this invention also provides a handheld mini wall polisher that has dust absorption and positioning functions. This invention is convenient and practical, and is applicable to chisel worn walls and polish new walls; It achieves polishing automation reduces labor intensity, and enhances work efficiency; moreover, it can also enhance the esthetic appearance of polished walls.

9 Claims, 27 Drawing Sheets

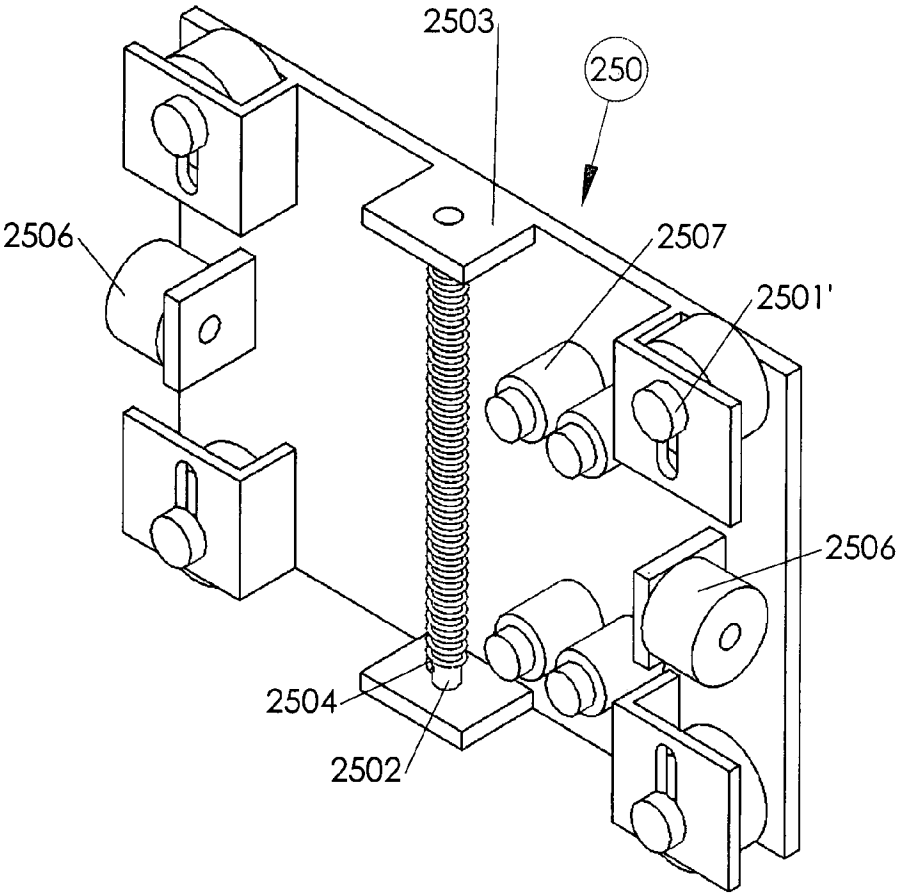
FIG 4C1

WALL/ROOF POLISHER

CLAIM OF PRIORITY

This application claims priority under 35 U.S.C. §119 to PCT Application No. PCT/CN03/00918 filed Dec. 30, 2003, which is hereby incorporated herein by reference in its entirety.

BACKGROUND OF THE INVENTION

1. Field of the Invention

The invention is related to a polisher for constructional fitting, in particular a polisher that may be used to polish walls and roofs and has self-leveling function.

2. Description of the Related Art

People usually do as follows during room fitting work: prepare plaster with emulsion and powder (e.g., calcium carbonate powder) and apply the plaster on the all; or polish the wall with a soft blade to form smooth wall; or polish the wall with sandpaper and then paint emulsion paint on the wall. Above polishing approaches have two characteristics: first, it achieves smooth wall face through polishing; second, it is carried out manually.

The wall polisher described in a prior patent application (application No.: 00114111.2) of the inventor utilizes a rotary sandstone sliding along a rail to polish walls; though that wall polisher overcomes inconvenience of manual operation, it has to be refined further in actual application, for example, how to eliminate position difference between rails of different sizes, how to collect dust created during polishing work, and how to achieve self-leveling on surface being polishes to reduce job difficulty, etc.

SUMMARY OF THE INVENTION

The purpose of this invention is to overcome defects in the existing apparatus and provide a polisher that has features including high stability, low vibration, self-leveling, and dust-absorption, and always sticks to the wall (roof) seamlessly during the polishing work to reduce job difficulty.

To attain above purpose, this invention employs the following technical solution:

The wall polisher provided in this invention mainly comprises a movable seat, an external motor on the seat, a plurality of rails mounted vertically on the seat and in parallel to each other, a built-in motor that can sliding along the rail, a sandstone cylinder driven by the built-in motor, and a suspension beam on the top of the rails.

Said seat has an upright post; said rails are mounted on sliding plates, which are fitted over said upright post.

Said sandstone cylinder has a protection hood, which has a positioning pulley at the side near the wall and an air outlet and a dust absorption mouth at bottom; said dust absorption mouth has a flat and long air inlet, a chamber connected to that air inlet, and hose outlets at both sides of the chamber; said hose outlets are connected to hoses of a dust collector; said dust absorption mouth is made of a soft rubber material; said protection hood of the sandstone cylinder has a baffle plate at bottom; a annular soft rubber dust pipe is fixed in said baffle plate.

Said rails are made of unsaturated reinforced resin glass and comprise big, medium, and small rails connected to each other; the cross sections of the rails are rectangular with a notch at one side to enable the main shaft to slide up and down; the rails are connected to each other at front and rear sides against the wall.

The rails on sliding plates are made of unsaturated reinforced resin glass and comprise big and small rails connected to each other; the cross section of said rails are in "□" shape with a notch on one side to enable the main shaft to sliding up and down; the rails are fixed to each other at front and rear sides against the wall. A position difference correction rail is devised among those rails to correct position difference between those rails; the inner diameter and outer diameter of said position difference correction rail are equal to those of the small rails, thus it can sliding freely in the medium rails.

Said built-in motor is an electric roller, the casing of which is connected with through fixing flange. There is a positioning threaded rod at front side of said rails near the wall or in the rails. There are a pulley and steel ropes at each side of said suspension beam; said steel ropes are used to suspend both ends of said built-in motor. A main shaft control device is mounted in said small rails.

The invention provides a mini wall polisher comprising two parts: motor part and polishing sandstone cylinder part fixed on the motor and protected with a protection hood; said protection hood has two positioning plates, adjusting grooves, and nuts at the bottom.

There are dust pipes at said sandstone cylinders; the protrusion length of said dust pipes is equal to the diameter of said sandstone cylinder; said dust pipes run into said motor part and are connected to a hose to an external fan at their rear ends. Said dust pipes are converged to a main pipe at the motor part and the main pipe is connected to the external fan. There are grooves on the inner walls of said dust pipes.

The technical solution in this invention has the following advantages:

(1) It achieves wall polishing automation effectively and decreases labor intensity and improves work efficiency;

(2) It expands the applicability of the machine and may be used to polish inner walls, external walls of rooms of different heights and roofs;

(3) The polisher utilizes the built-in spring in the sliding plate to achieve self-leveling, thus the sandstone cylinder always stick to the wall seamlessly;

The guide sleeve can prevent excessive friction during sliding action and avoid excessive tilting of the support plate during the polishing work.

BRIEF DESCRIPTION OF THE DRAWINGS

FIG. 2B shows the structure of another guide device applicable to the polisher in this invention;

FIG. 4C1 shows another structure of the sliding part in FIG. 3C;

DETAILED DESCRIPTION OF THE PREFERRED EMBODIMENT

Entire Machine and Its Working Principle

Figure 1:
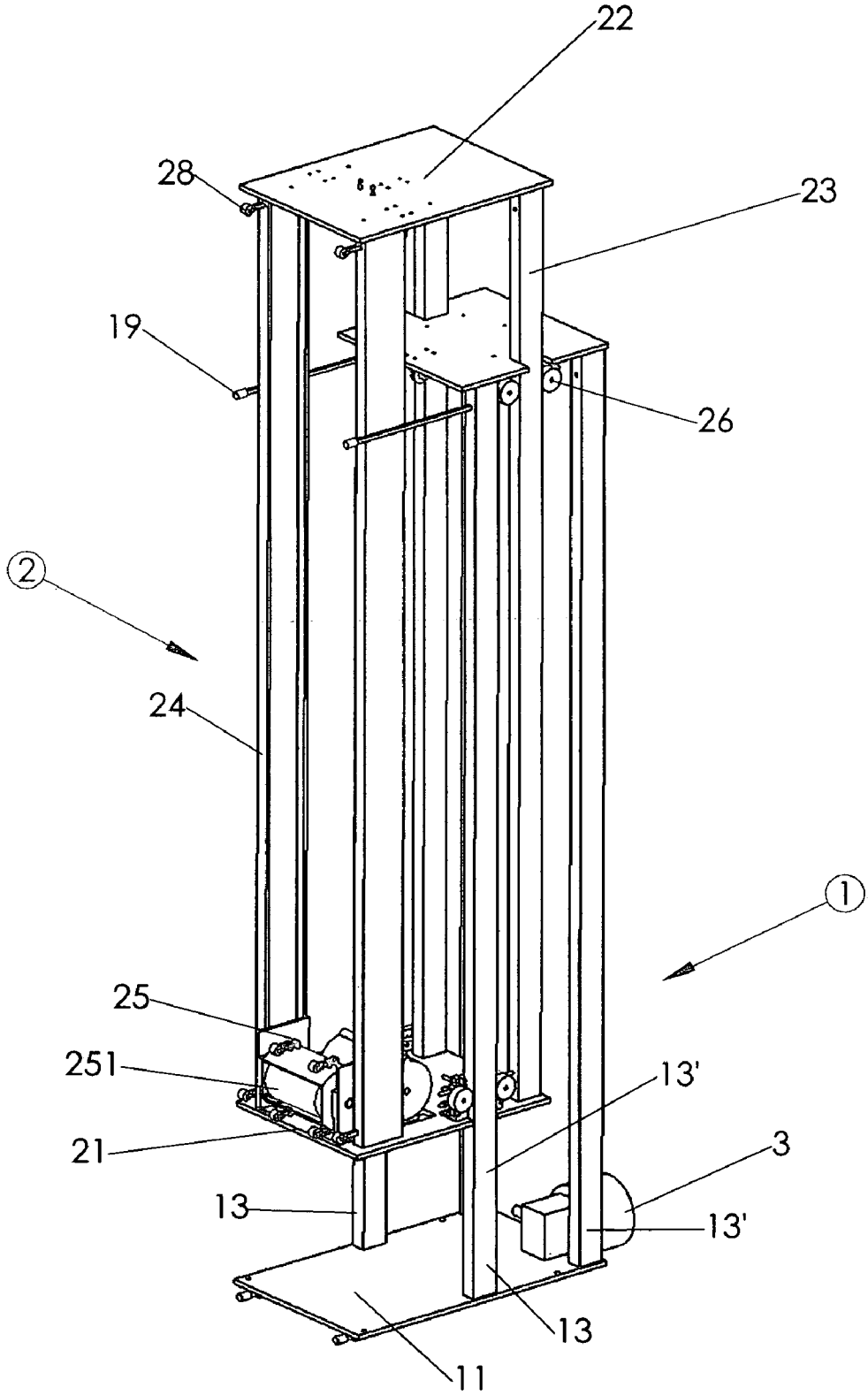
FIG. 1 shows the entire polisher in this invention.
Figure 1B:
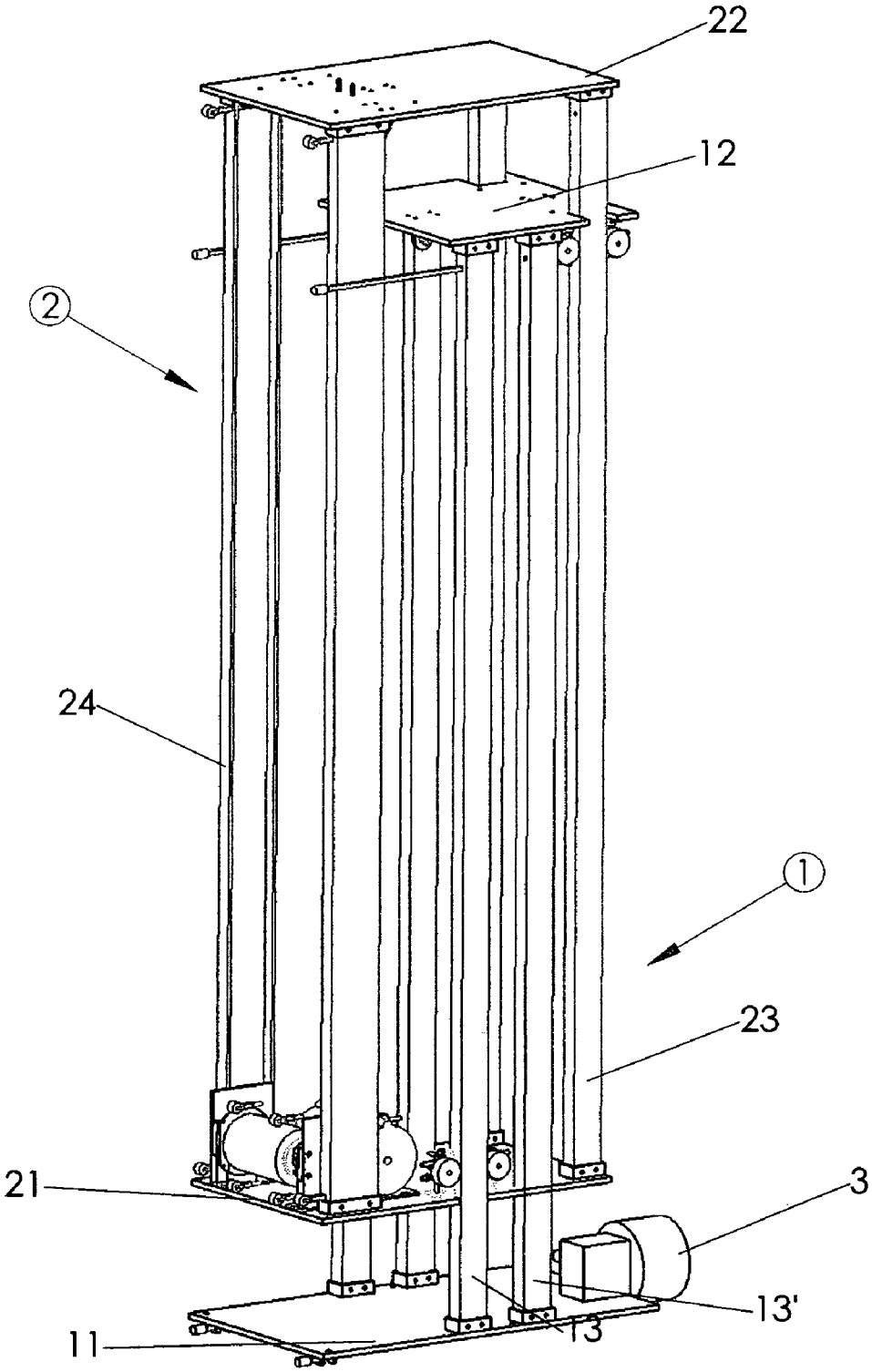
FIG. 1B shows the entire polisher in another assembling mode.
Figure 1C:
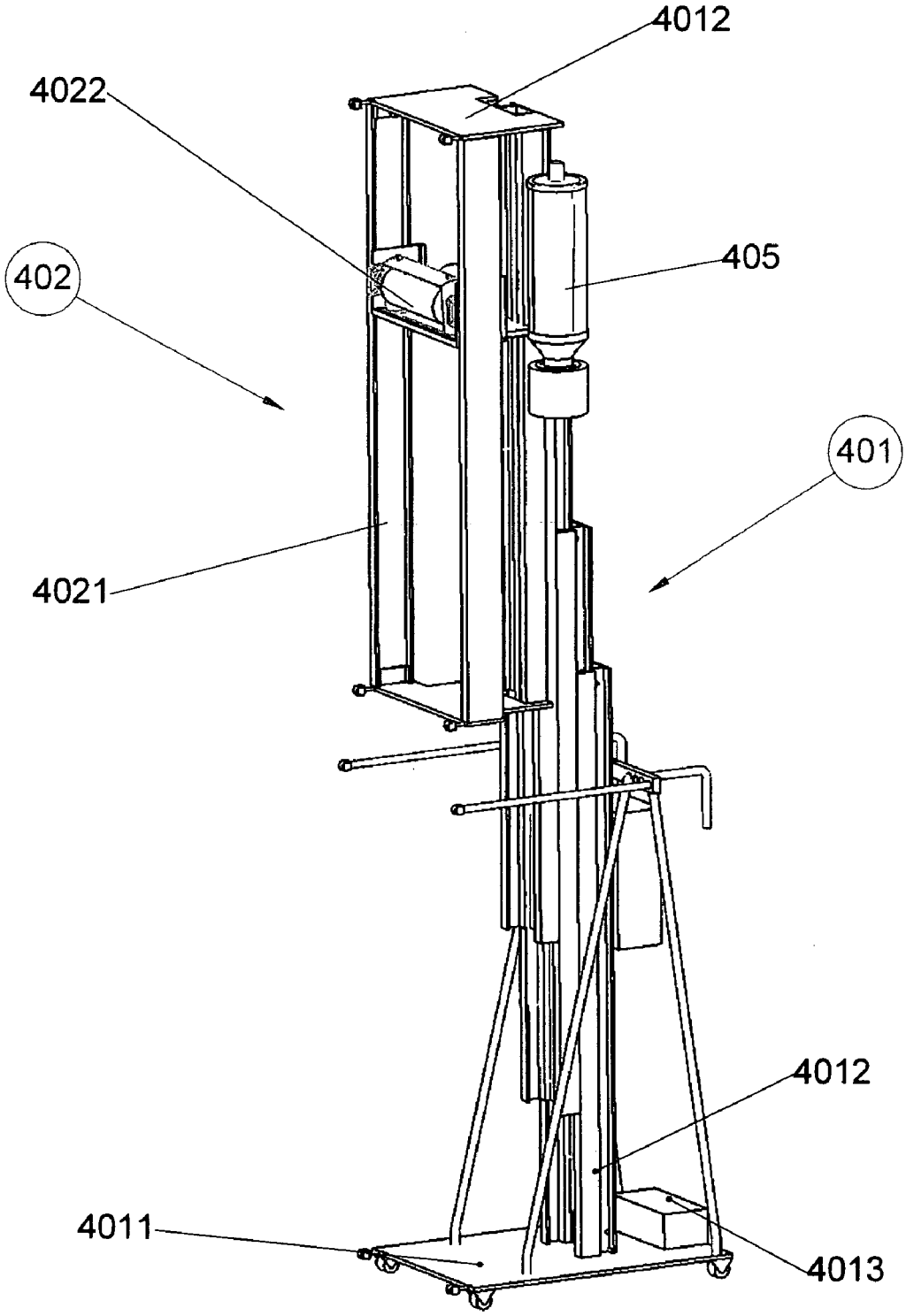
FIG. 1C shows the entire polisher that utilizes a lifting platform.

Please see FIG. 1C, the assembly drawing of the entire machine in this invention. The entire machine in this invention comprises a lifting platform 401 and a polishing unit 402; wherein said lifting platform 401 can lift up or drop down the polishing unit 402 to polish a working surface at specific altitude.

The structure of the lifting platform 401 may be diverse. FIG. 1C shows a structure, which comprises a underplate 4011, rails 4012 fixed on the underplate 4011, and a motor 4013 fixed on the rails 4012; wherein said rails 4012 may be a plurality of rails fitted to each other, and at least one of them is fixed on the underplate 4011; the topmost rail is connected to the polishing unit 402, and the transmission may be screw rod transmission or chain transmission.

The structure of the polishing unit 402 may be diverse. FIG. 1C shows a structure, which comprises a sliding rack 4021 and a polishing cylinder 4022 mounted on the sliding rack 4021; said sliding rack 4021 is fixed on the rails 4012 of the lifting platform 401. Another type of polishing unit 402 (not shown) may be a polishing cylinder that utilizes a built-in motor; said polishing cylinder is directly fitted to the rails 4012.

Figure 5A:
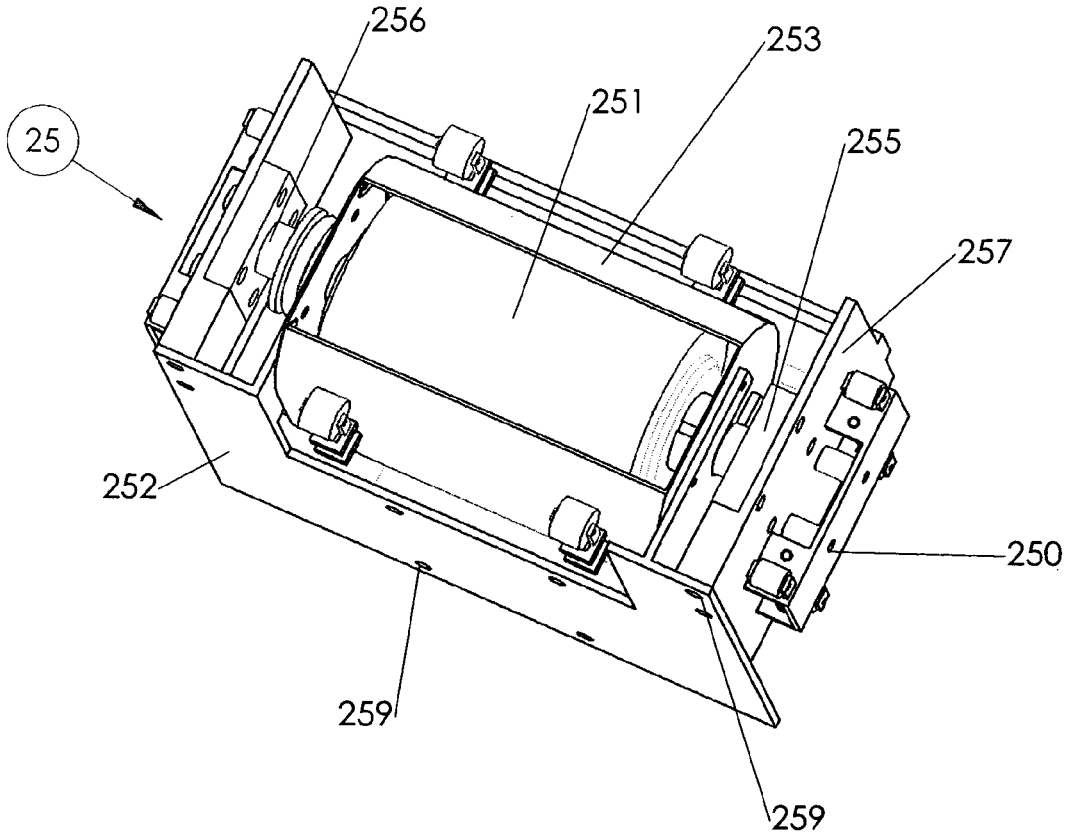
FIG. 5A shows the three-dimensional structure of the sandstone disk frame of the polisher in this invention.
Figure 5B:
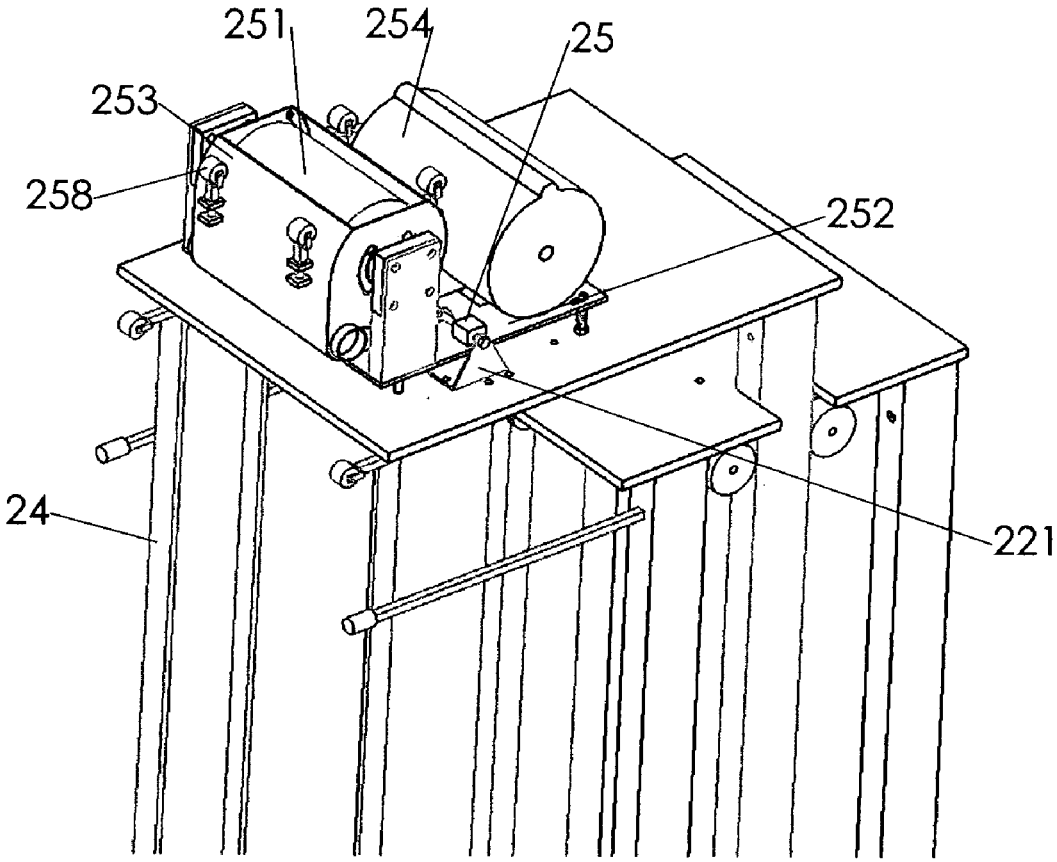
FIG. 5B is a structural and installation diagram of the sandstone disk frame of the polisher in this invention for roof polishing work.

Another assembling method for the wall/roof polisher in this invention is shown in FIG. 1, FIG. 1B, and FIG. 5B; wherein the lifting platform is a fixed part 1, and the polishing unit is a sliding part 2; said fixed part 1 comprises a seat 11, a top plate 12, and several upright posts (13, 13') mounted in parallel between the seat 11 and the top plate 12 (in the embodiment in FIG. 1, there are 4 upright posts: 2 front upright posts (13) are mounted in the middle of the seat 11 at bottom and on front edge of the top plate 12 at top; 2 rear upright posts 13' are mounted on the rear edge of the seat 11 at bottom and on rear edge of the top plate 12 at top; in the embodiment in FIG. 1B, the 4 upright posts (13, 13') are mounted in the middle of the seat 11 and the top plate 12, separately), moving pulleys (not shown) mounted under said seat 11 to adjust the altitude of seat 11 and control the rotation direction in order to enable the fixed part 1 to move in whole; said sliding part 2 comprises an upper support plate 22, a lower support plate 21, and two support posts 23 and two sliding rails 24 between the support plates 21 and 22; said support posts 23 pass through the top plate 12 of the fixed part 1 (in FIG. 1, they pass through between front upright posts 13 and rear upright posts 13'; in FIG. 1B, they pass through behind the four upright posts); in another installation method, an I-beam may be used as the sliding rail 24, and the front upright posts 13 of the fixed part 1 may be placed in the I-beam, and then the pulleys may be mounted.

There is a motor 3 mounted on the seat 11 of said fixed part 1, said motor 3 drives said sliding part 2 to slide along the front upright post 13 of said fixed part 1; a sandstone disk frame 25 is fixed on the support plate of said sliding part 2 (during wall polishing work, said sandstone disk frame 25 is fixed on the lower support plate 21, as shown in FIG. 1; during roof polishing work, said sandstone disk frame 25 is fixed on the upper support plate 22, as shown in FIG. 5B); the sandstone disk 251 in said sandstone disk frame 25 is used to polish wall or roof.

Figure 7A:
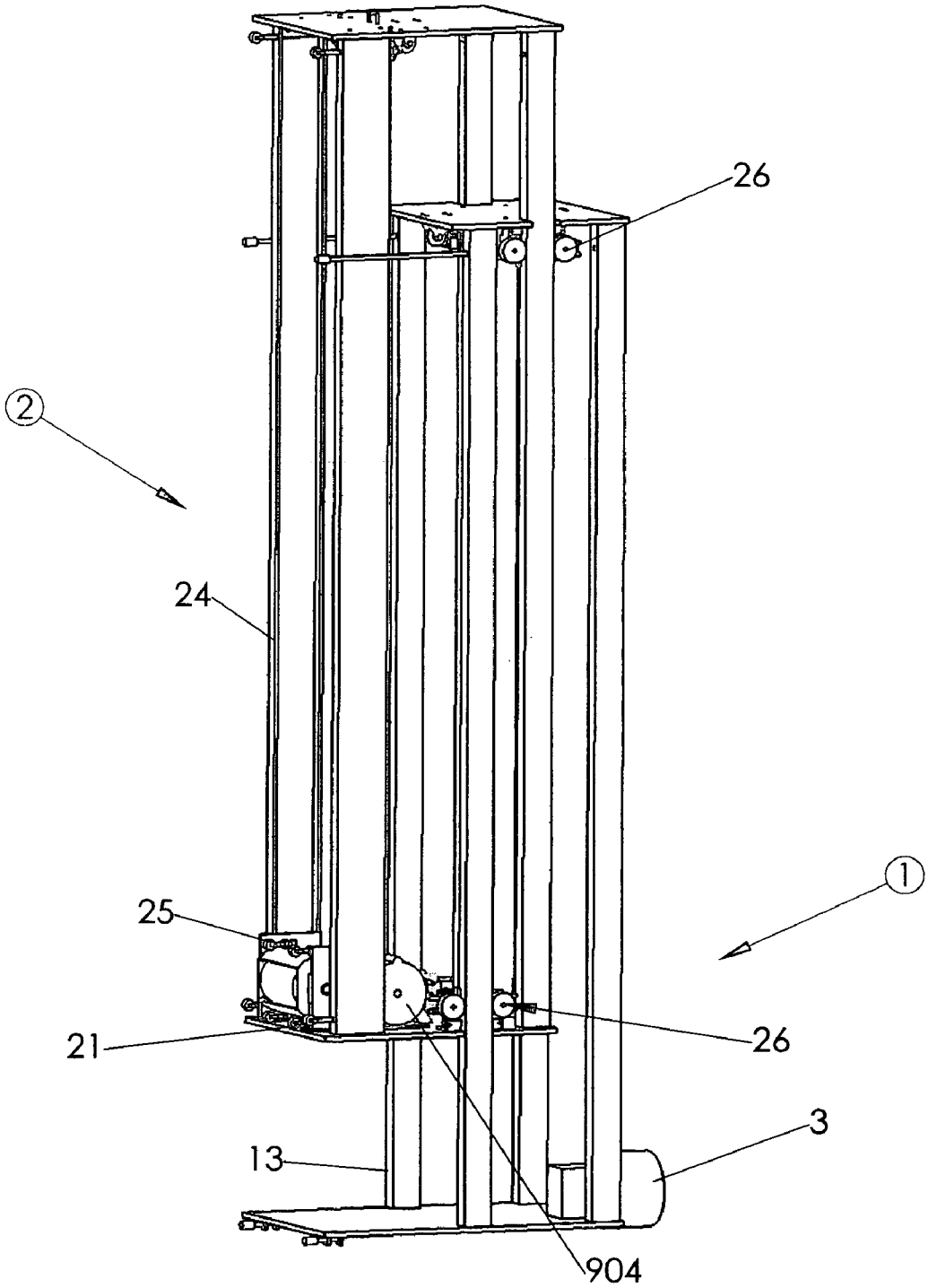
FIG. 7A shows the positions of the pulleys that enable the sliding part and the sandstone disk frame of the polisher to move.
Figure 7B:
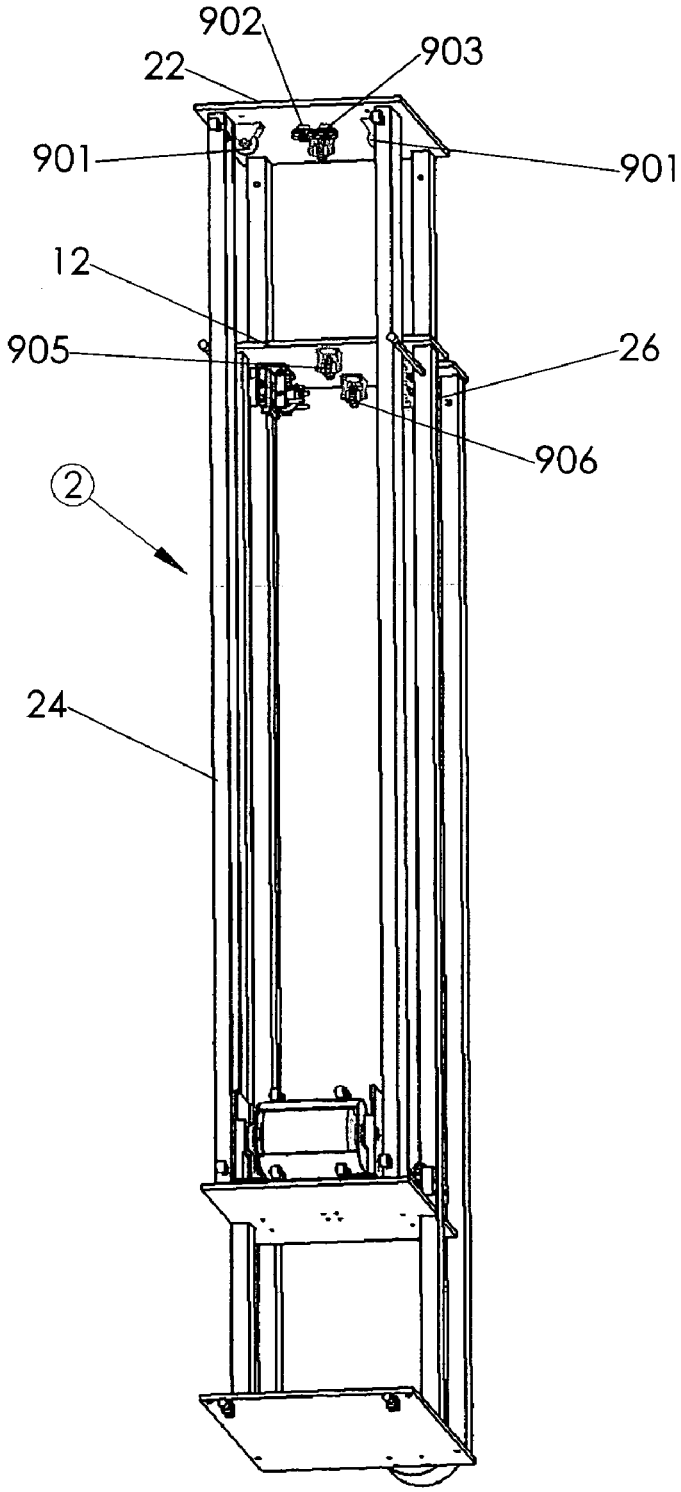
FIG. 7B is another view of the positions of the pulleys that enable the sliding part and the sandstone disk frame of the polisher to move.

See FIG. 7A and FIG. 7B, wherein several pulleys are mounted on the polisher in this invention so that the sliding part 2 can be lifted and the sandstone disk frame 25 can slide. There are 5 pulleys on the upper support plate 22 of the sliding part 2: 2 lifting pulleys 901 at both sides, 2 deflecting pulleys 902 in the middle, and another lifting pulley 903 between the deflecting pulleys 902; there are two steel ropes (not shown) suspended at both ends of the sandstone disk frame 25 and they pass through the lifting pulleys 901, the deflecting pulleys 902, the lifting pulley 903, and then run downwards; one or two lifting pulleys 904 are mounted on the lower support plate 21 of the sliding part 2; the steel rope running down from the lifting pulley 903 passes through the lifting pulley 904 and then run upwards; there is a lifting pulley 905 and a deflecting pulley 906 below the top plate 12 of the fixed part 1; the steel rope passes through the lifting pulley 905 and the deflecting pulley 906 and run downwards into the rope rollers at both ends of the motor 3 on the seat 11, so that the motor 3 drives the sandstone disk frame 25 to slide in the slide rails 24 and drives the sliding part 2 to slide along the front upright posts 13 of the fixed part 1.

In this invention, all components on the upper and lower support plates (21, 22) and the top plate 12 may be mounted separately; however, to simplify the mounting work, the support plate (21, 22), top plate 12, sleeves and small posts mounted on the rails 24 on those plates, and the hoisting pulleys and the steering pulleys 901~904 may be molded on the plates together through fiberglass reinforced plastic molding process.

Polishing Part

In this invention, the polishing part 402 accomplishes polishing work with the polishing cylinder. Said polishing cylinder may be a sandstone disk, a sandpaper cylinder, or a metal roller with smooth surface: a sandstone disk may be used to polish coating on worn wall; a sandpaper cylinder may be used to polish new wall to facilitate painting new paint; a metal roller may be used to polish hard coating on wall; in actual application, the polishing cylinder may be selected according to the actual situation of the wall.

Above polishing cylinder may be mounted in a frame 25 (the structure of it is shown in FIG. 5A and FIG. 5B); said frame 25 comprises a bottom plate 252, a sandstone disk 251 fixed on said bottom plate 252, a sandstone disk protection hood 253 that may turn 90°, and a motor 254 that is fixed on the bottom plate 252 and is used to drive the sandstone disk 251. The entire sandstone disk frame is fixed on the support plate via the fixing hole (piece) 259 on the bottom plate 252.

There are a bearing 255 at each end of the sandstone disk 251, wherein a pulley 256 is mounted on one bearing 255, which is connected to the motor 254. There is a baffle plate 257 at outer side of each bearing 255 and the baffle plate 257 is fixed on the bottom plate 252.

Either the sandpaper cylinder or the metal roller may be mounted in the frame 25 in the same way.

Figure 6:
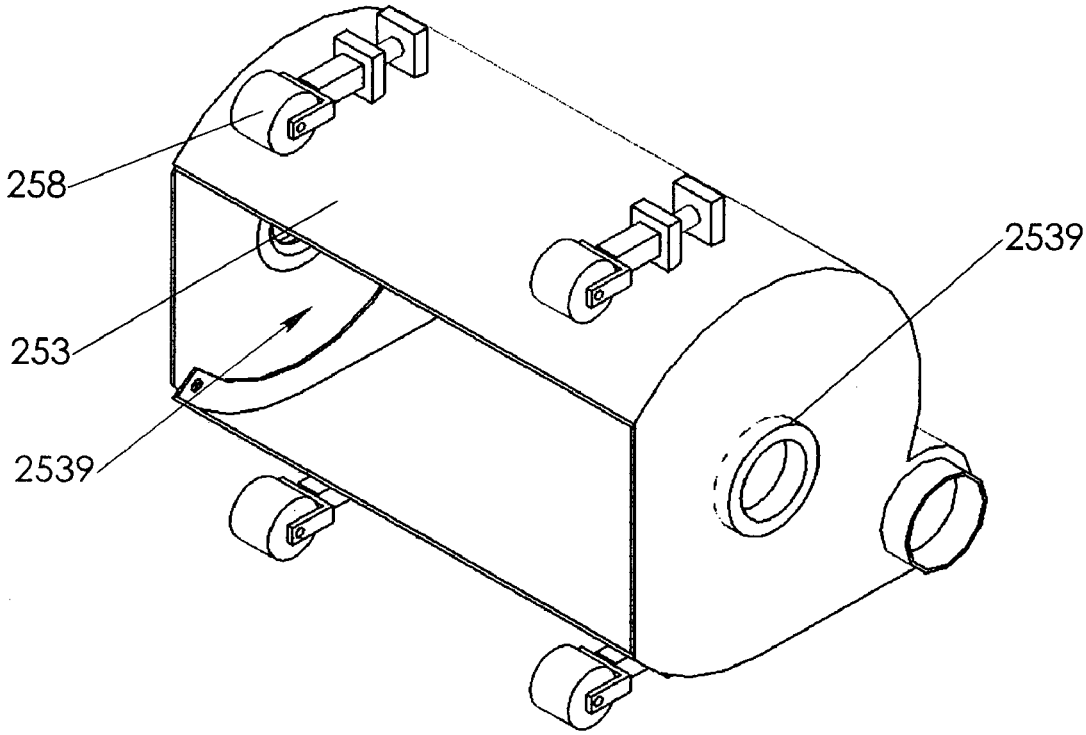
FIG. 6 shows the structure of the sandstone disk protection hood of the polisher in this invention.
Figure 6B:
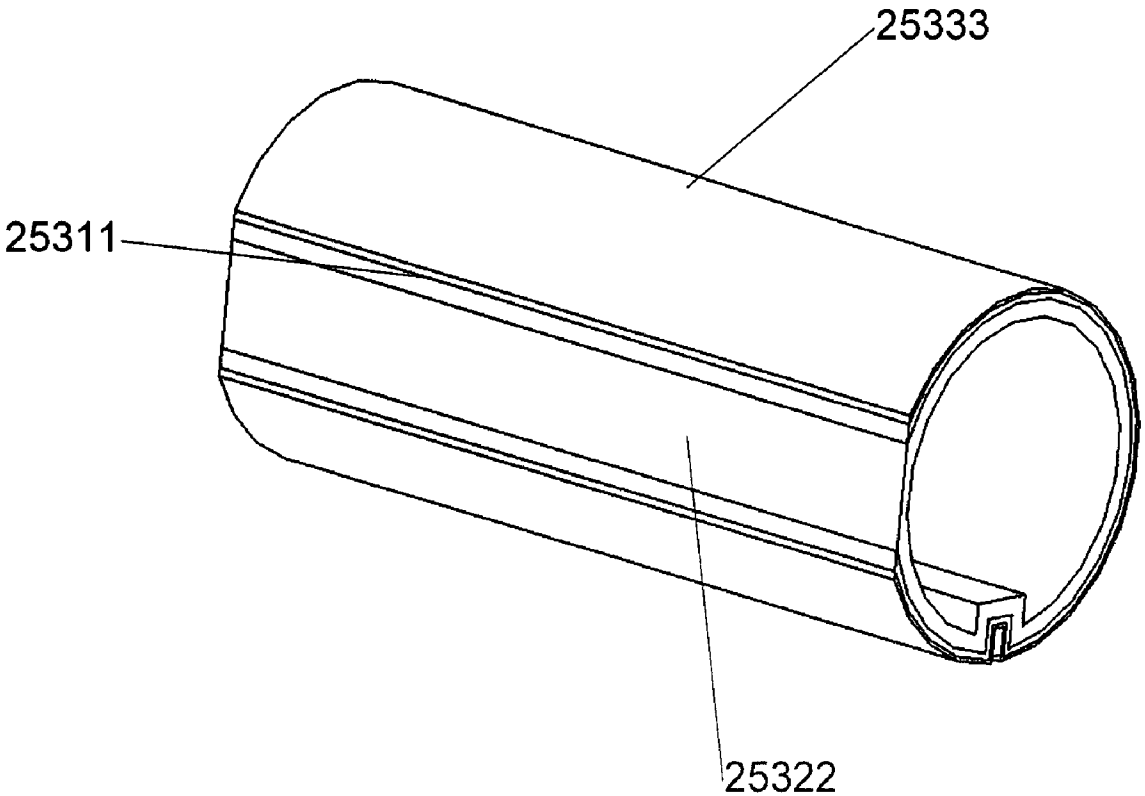
FIG. 6B shows another structure of the polishing cylinder of the polisher in this invention.

The structure of the sandpaper cylinder is shown in FIG. 6B. An elastic gum layer 25322 is coated on a bushing 25311, sandpaper 25333 is fixed to that elastic gum layer 25322 and the bushing 25311.

Figure 6C:
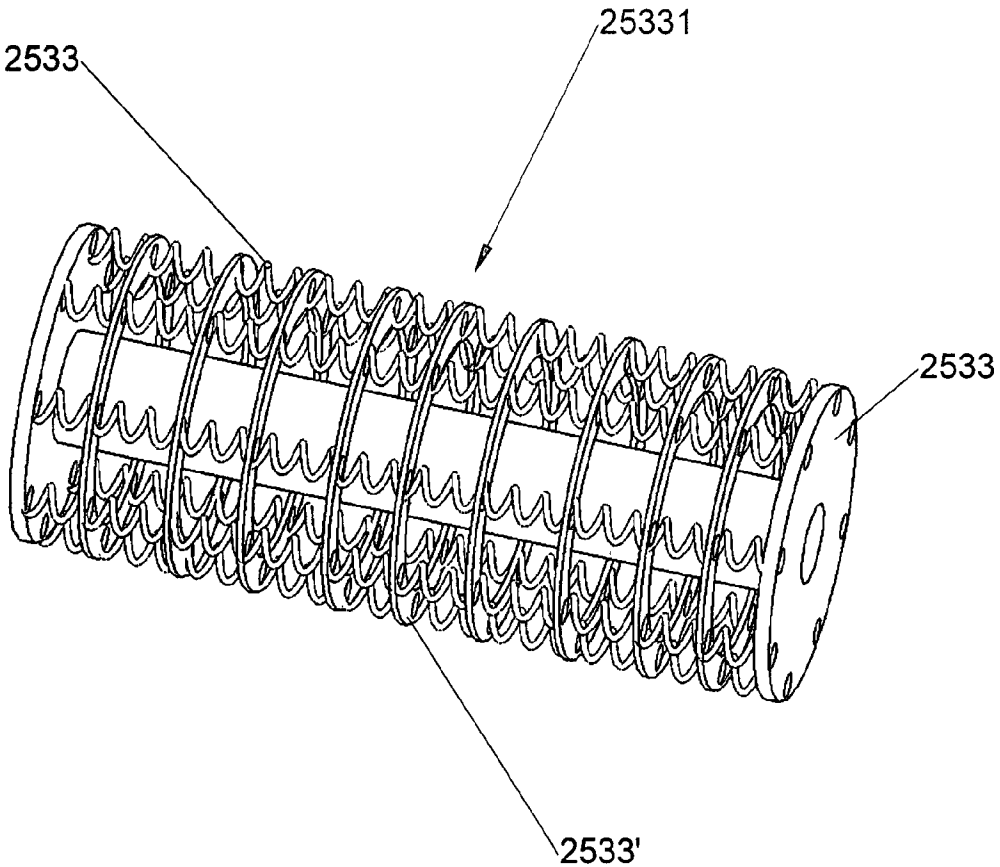
FIG. 6C shows another structure of the polishing cylinder of the polisher in this invention.

Another structure of the sandpaper cylinder is shown in FIG. 6C: a disk is fixed at each end of a cylinder; there are several springs 2533' pulled between the disks to form a cylinder; there are several iron rings in the cylinder and they are fixed on the springs; the sandpaper 2533' is fixed on the surface of the cylinder; round rods can be fitted on the springs to fix the springs on the disks 2532.

To ensure normal operation of the polishing cylinder during the polishing work, the polishing cylinder is protected with a protection hood 253 (see FIG. 6); 4 limiting/positioning pulleys 258 (springs may be added to them) are fixed at the notch of the protection hood 253 to limit the clearance between the polishing cylinder 251 and the working surface. There is a slide channel 2539 at each side of the protection hood 253 so that the protection hood 253 can turn 90° along the slide channels.

Figure 10:
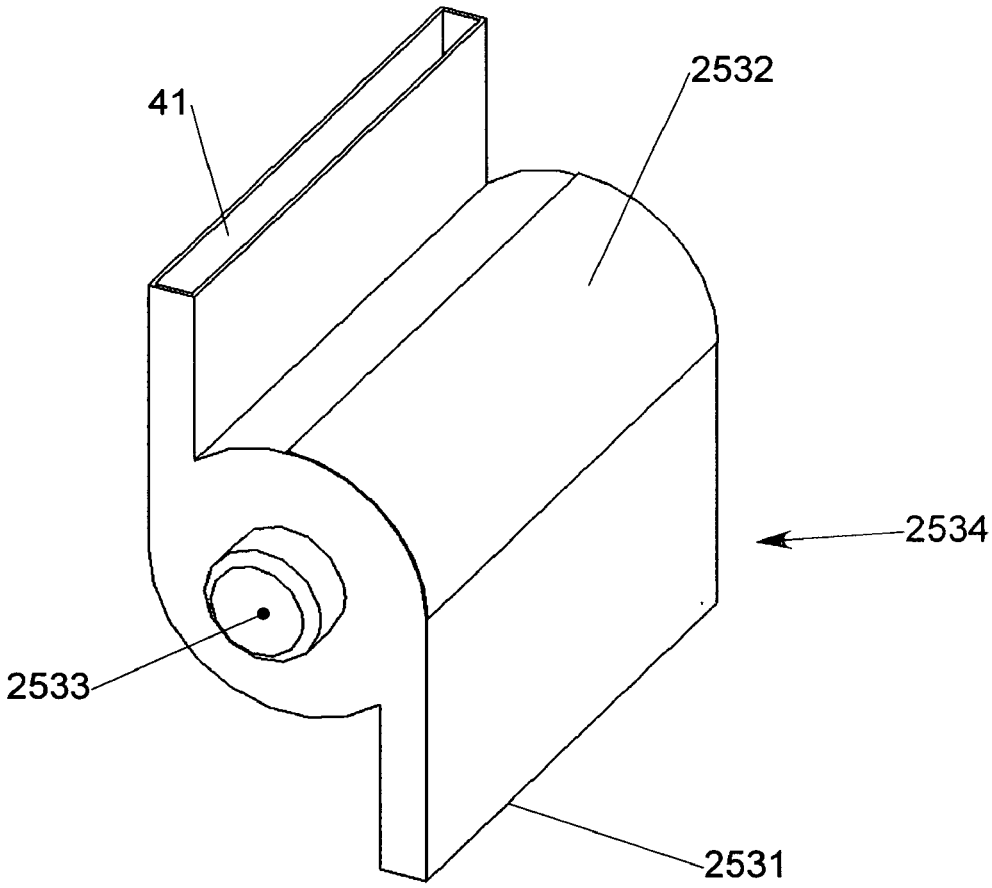
FIG. 10 shows the structure of the dust absorption mouth of the polisher in this invention.

A dust collecting device may be added on the protection hood 253, as shown in FIG. 10.

A frame 25 is mounted on the upper support plate 21, as shown in FIG. 5B; the protection hood 253 can turn 90°; another fixing part 2591 is mounted on the bottom plate 252 to fix the bottom plate 252 to the corner bracket 221 on the upper support plate 21.

Figure 4A:
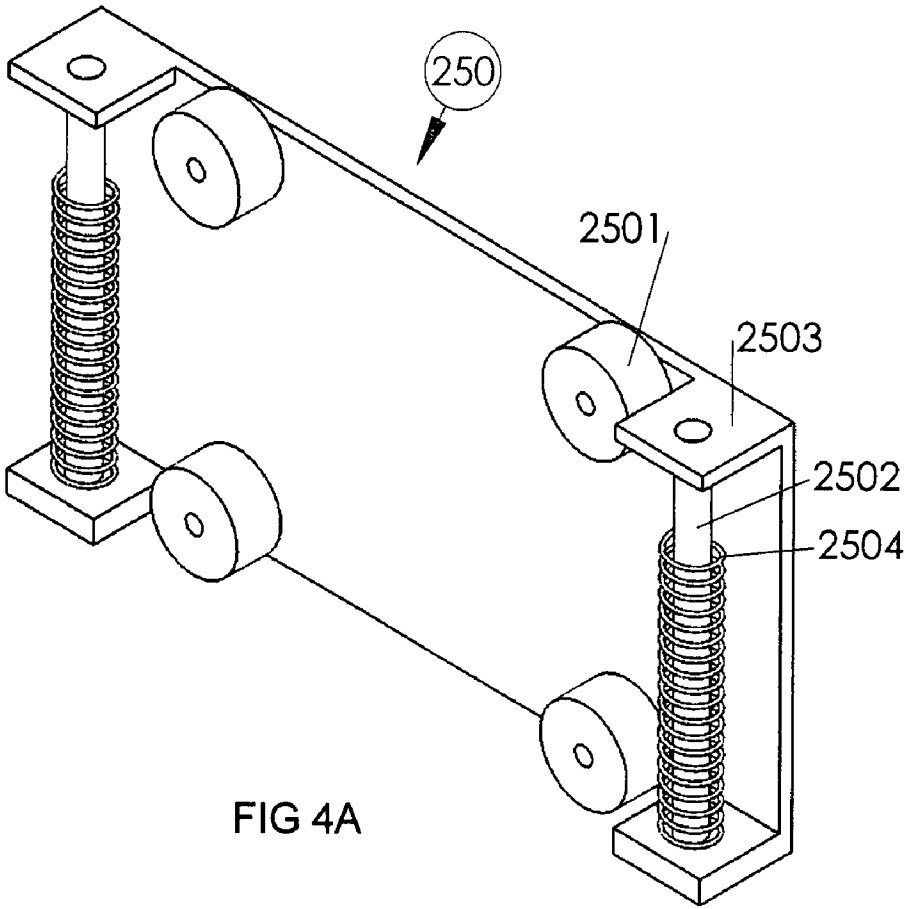
FIG. 4A shows the structure of the sliding part in FIG. 3A.

A frame 25 is fixed on the lower support plate 21, as shown in FIG. 5A; in addition, a sliding block 250 is mounted at outer side of the bearing baffle plate 257. The sliding block 250 has 4 small pulleys 2501, as shown in FIG. 4A, FIG. 4B, and FIG. 4C; said sliding block 250 is in the two slide rails 24 of the sliding part 2 and can slide in them.

Figure 3A:
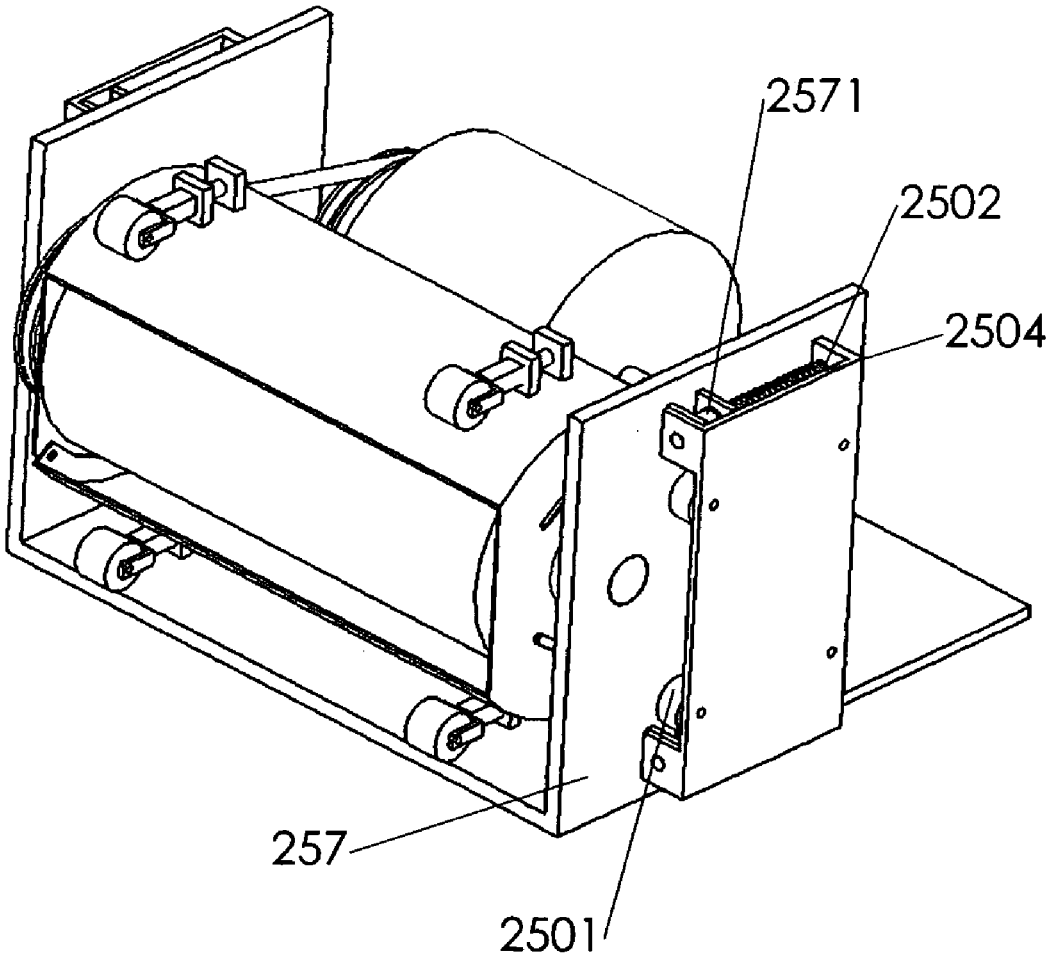
FIG. 3A shows the structure of another sandstone disk frame applicable to the polisher in this invention.

The structure of the sliding block 250 may be diverse. As shown in FIG. 4A, there is a naked shaft 2502 vertical to the sliding direction (Direction A) at each end of the sliding block 250; said naked shafts 2502 are mounted between the baffle plate 2503 of the sliding block and are fitted with a spring 2504 respectively; said naked shafts 2502 are detachable; in the sandstone disk frame 25 (see FIG. 3A) corresponding to the naked shaft structure, two linear bearings 2571 are fixed at top/bottom of the bearing baffle plate 257, respectively; the naked shafts 2502 of said sliding block 250 pass through said linear bearings 2571 respectively, and said springs 2504 prop the fixing frames of said linear bearings 2571, respectively.

Figure 3B:
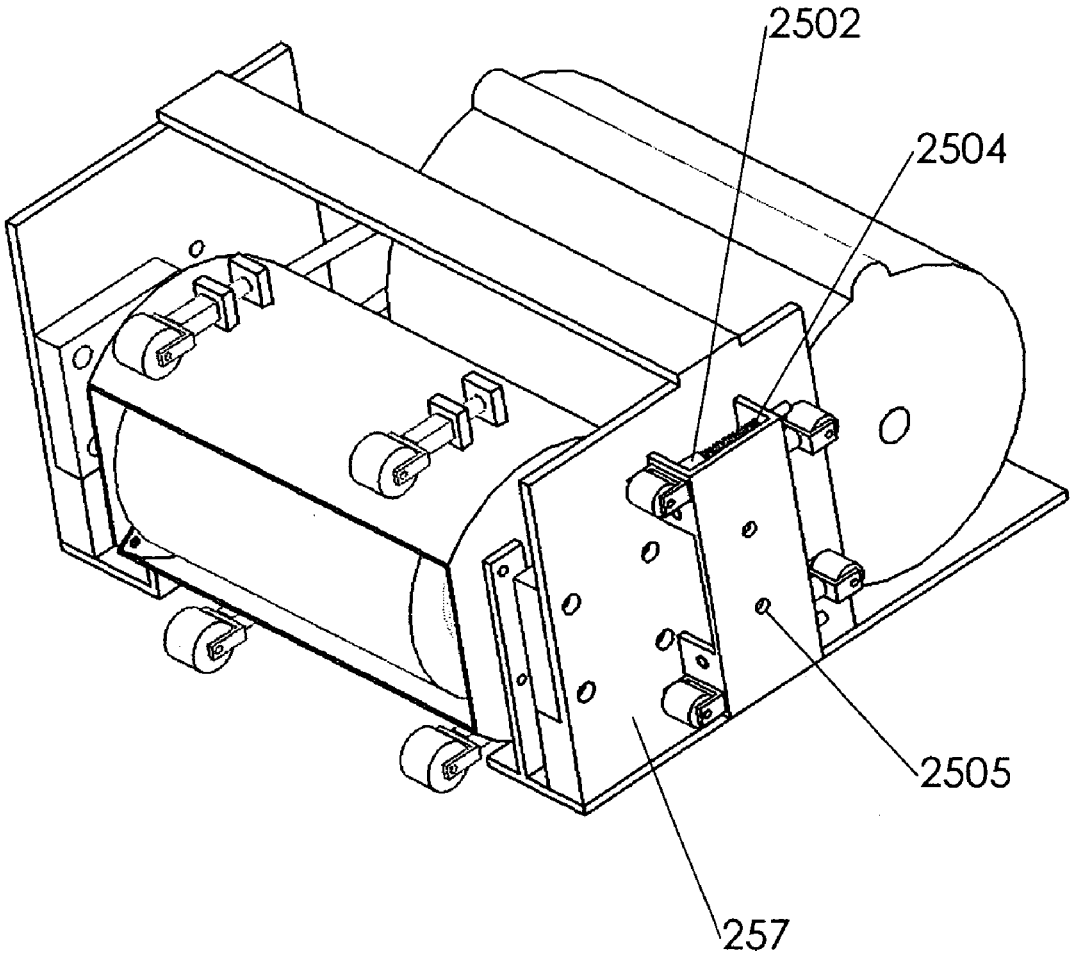
FIG. 3B shows the structure of another sandstone disk frame applicable to the polisher in this invention.
Figure 3C:
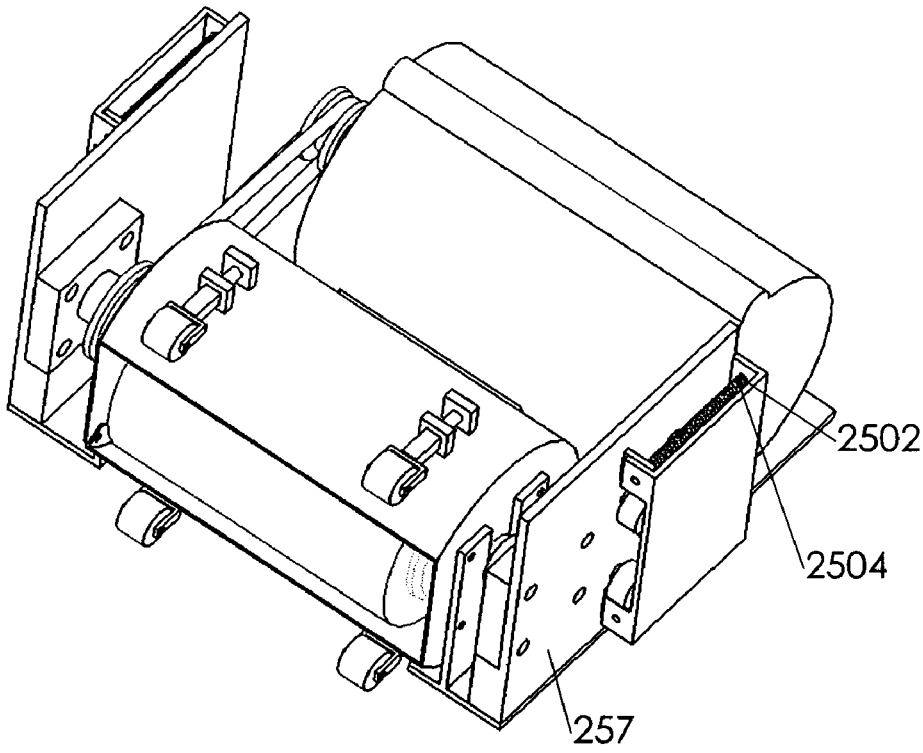
FIG. 3C shows the structure of another sandstone disk frame applicable to the polisher of this invention.
Figure 4B:
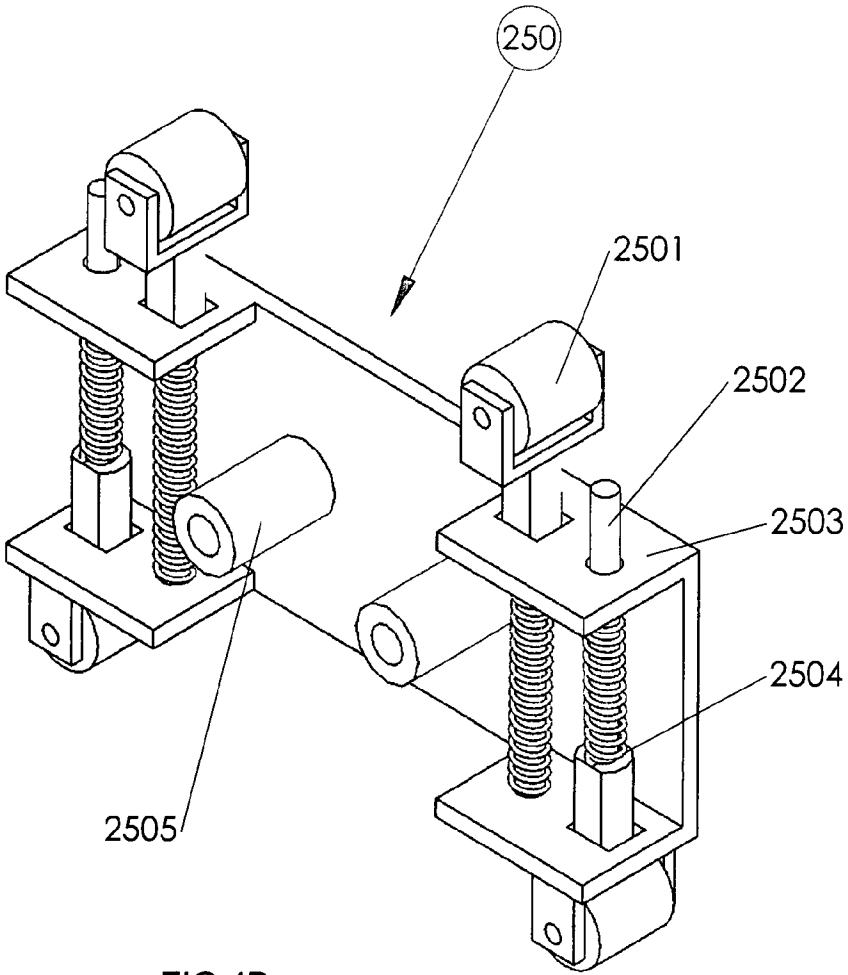
FIG. 4B shows the structure of the sliding part in FIG. 3B.

FIG. 4B shows another structure of said sliding block 250, wherein the small pulleys 2501 of said sliding block 250 are connected to a naked shaft 2502' respectively; said naked shafts 2502 are fitted with a spring 250 respectively, and the other end of each naked shaft 2502 is fixed at the other side of said sliding block 250 in a detachable manner (e.g., fixed with nuts (not shown)) so that it can stretch freely. The sliding block 250 of that structure is fixed to the bearing baffle plates 257 of the sandstone disk frame 25 through the fixing holes 2505, as shown in FIG. 3B.

Figure 4C:
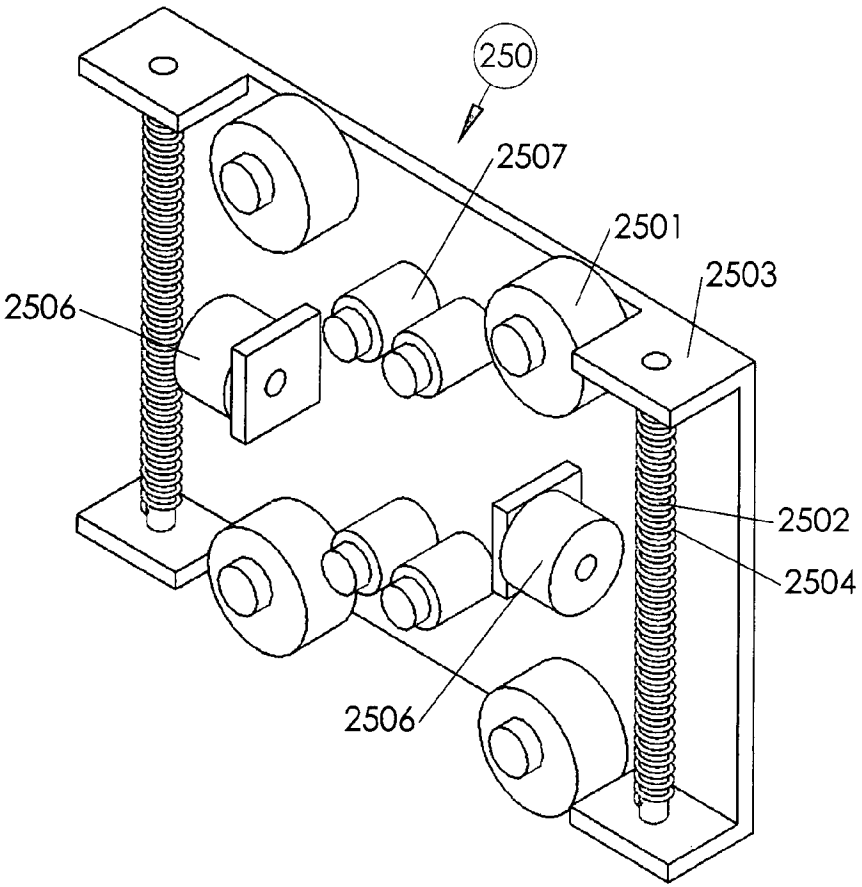
FIG. 4C shows the structure of the sliding part in FIG. 3C.

FIG. 4C shows another structure of the sliding block 250, wherein there are 4 eccentric pulleys 2501 (may be substituted with common grooved pulleys, as 2501' shown in FIG. 4C1) on the sliding block 250; there is a naked shaft 2502 vertical to the sliding direction (Direction A) at each end of said sliding block 250; said naked shafts 2502 are mounted between the baffle plates 2503 of the sliding block and are fitted with a spring 2504 respectively; said naked shafts 2502 pass through a small slab fixed to the bearing baffle plate 257 at one end and are fixed to the baffle plate 2503 of the sliding block in a detachable manner at the other end; a set of pulleys 2506 are fixed on the sliding block 250 to reduce friction between the baffle plate 2503 of the sliding block and the bearing baffle plates 257; there are another 2 sets of pulleys 2507 on the sliding block 250, and another baffle plate (not shown) may be inserted into the gap between the 2 sets of pulleys 2507 and fixed to the baffle plate 2503 to drive the sliding block 250 to slide up and down; the difference between FIG. 4C1 and FIG. 4C is: there is only one spring 2504 in FIG. 4C1, and the eccentric pulley 2501 in FIG. 4C is substituted with a common grooved pulley 2510 in FIG. 4C1.

The spring 2504 in any of above structures of the sliding block 250 may create counter force under the pushing force of the operator during the polishing work, so that the sandstone cylinder always stick to uneven wall face. The polishing accuracy may be adjusted through adjusting the contracting range of the spring 2504.

In this invention, all of the components mounted on the bearing baffle plates 257 may be mounted separately or molded together during the bearing baffle plates 257 are molded.

Guiding Device

Figure 2:
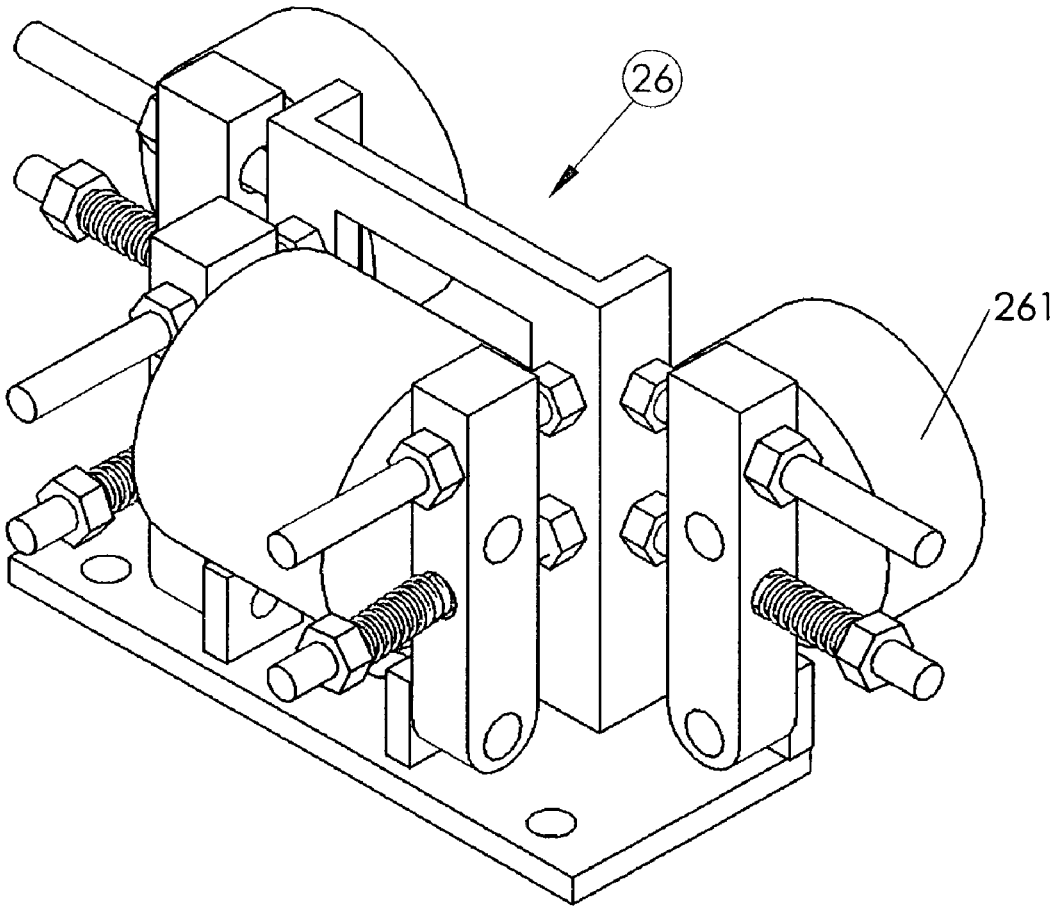
FIG. 2 shows the structure of the guide sleeve in the polisher.

Please see FIG. 1, wherein two guide sleeves 26 are mounted on the lower support plate 21 of said sliding part 2, corresponding to the two front upright posts 13 of the fixing part 1; whereas two identical guide sleeves 26 are mounted on the bottom of top plate 12 of the fixing part 1, corresponding to the two support posts 23 of the sliding part 2. The structure of the guide sleeves 26 is shown in FIG. 2; the two pulleys 261 of said guide sleeves 26 will prop the side faces of said upright posts 13 and support posts 23 and roll along said side faces when the sliding part 2 slides along the fixing part 1. The action of guide sleeves 26 can reduce friction between the top plate 12 and the upright posts 13 and tilt of the sliding part 2, and prevent the upright posts 13 from bearing excessive pressure through the limiting action of the holes.

FIG. 2B shows another guiding device, which is a spring device mounted directly on the support plate 21 and the top plate 12.

Slide Rail and Main Shaft Control Device

The following issues are considered in the design of this invention:

(1) Presently, rails in mechanical equipment usually employ U-steel cross section; however, rails of U-steel cross section will increase shock and degrade accuracy in this invention. Therefore, "□" shape cross section is used in this invention, and the corners are designed in circular arc shape or even circular shape.

(2) The lower the gravity center is, the higher the stability is. The "Synthetic Resin and Plastics—Synthetic Fiber" issued by Chemical Industry Press describes: "unsaturated polyester fiberglass reinforced plastics is excellent in mechanical properties. Fiberglass reinforced plastics reinforced with non-alkali glass cloth or fiber glass is similar to steel in some properties but the density of it is only ¼~⅕ of Fe or ½ of Al; it is easy to shape and possesses superior chemical properties. This invention employs unsaturated polyester fiberglass reinforced plastics for the frame and slide rails 24 to reduce the weight of the upper portion; so that the gravity center of the machine is lowered and the stability is enhanced. In addition, it also facilities installation and handling of the equipment; in view that resin plastic products are easy to distort and low in wear-ability, sheet iron, tin foil, or other wear resistant materials may be used to protect the slide rails; both the top plate and the bottom plate can be made of fiberglass reinforced plastics.

(3) When the wall polisher is used to polish inner walls, small rails of 1.5 m length can be fitted into big rails of 2.5 m length to meet the altitude requirement in view that the inner walls usually don't exceed 4 m in height. The shorter the rails are, the higher the stability is.

Figure 8:
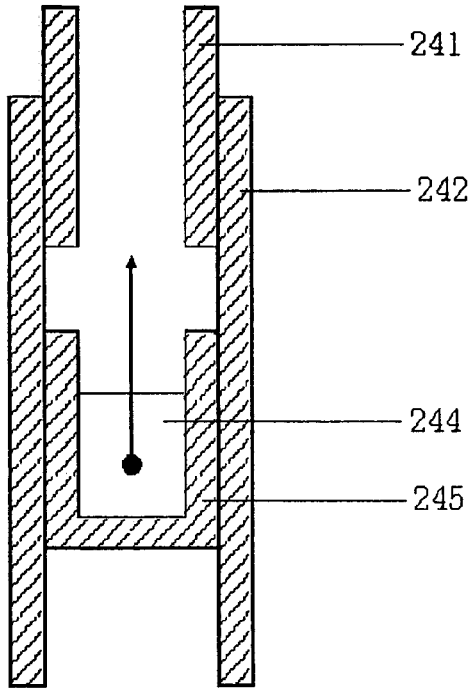
FIG. 8 is an assembly drawing of the sliding rails of the polisher as well as a schematic diagram of the position difference correction rail of the polisher in this invention.

The slide rails 24 on the sliding part 2 are assembled through fitting bigger rails over smaller ones, as shown in FIG. 8; the dimensions of external walls of smaller rails are almost the same as those of inner walls of bigger rails. There are fixing holes 243 on rails 241 and 242. Therefore, the rails 241 and 242 may be fixed to each other at the fixing holes 243.

As shown in FIG. 8, smaller rails 241 are mounted in bigger rails 242, and the main shaft control device 244 and the position difference correction rail 245 are mounted in those rails; when the main shaft control device 244 moves in the bigger rails 242, the position difference correction rail 245 will move along with the main shaft control device 244 under magnetic force; when the main shaft control device 244 moves upwards and enters into the smaller rails 241, the top of the position difference correction rail 245 will touch the bottom of the smaller rails 241 and will be linked to the smaller rails 241 under magnetic force; when the main shaft control device 244 moves downwards, the case is reverse; the main shaft control device 244 and the position difference correction rail 245 are equipped with a magnetic material.

In this invention, if the motor 254 that drives the sandstone disk 251 is a built-in one, the main shaft of the motor will serve as the stator and should not rotate. To attain this purpose, a main shaft control device 244 should be added.

Figure 9A:
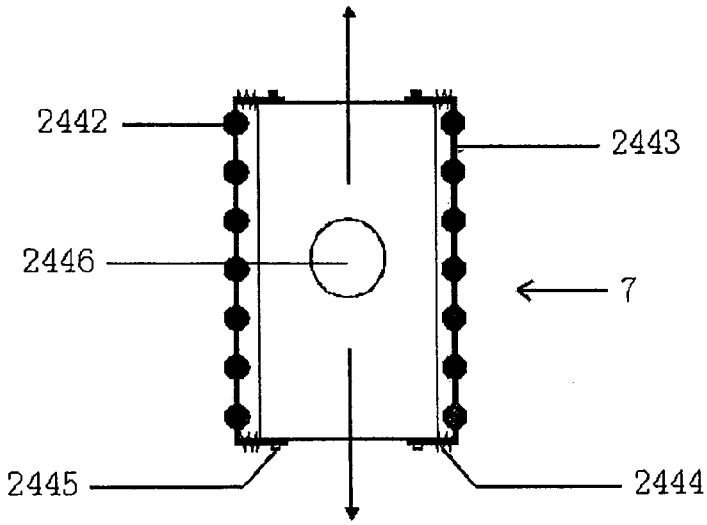
FIG. 9A shows the structure of the main shaft control device in FIG. 8.

FIG. 9A shows above main shaft control device 244, which comprises small bearings 2442, vertical shaft 2443, small spring 2444, screw 2445, and main shaft hole 2446; the small bearings 2442 are mounted on a vertical shaft 2443, and the main shaft control device 244 is adjusted with screw 2445 and spring 2444 to adapt to the rail 241.

Figure 9B:
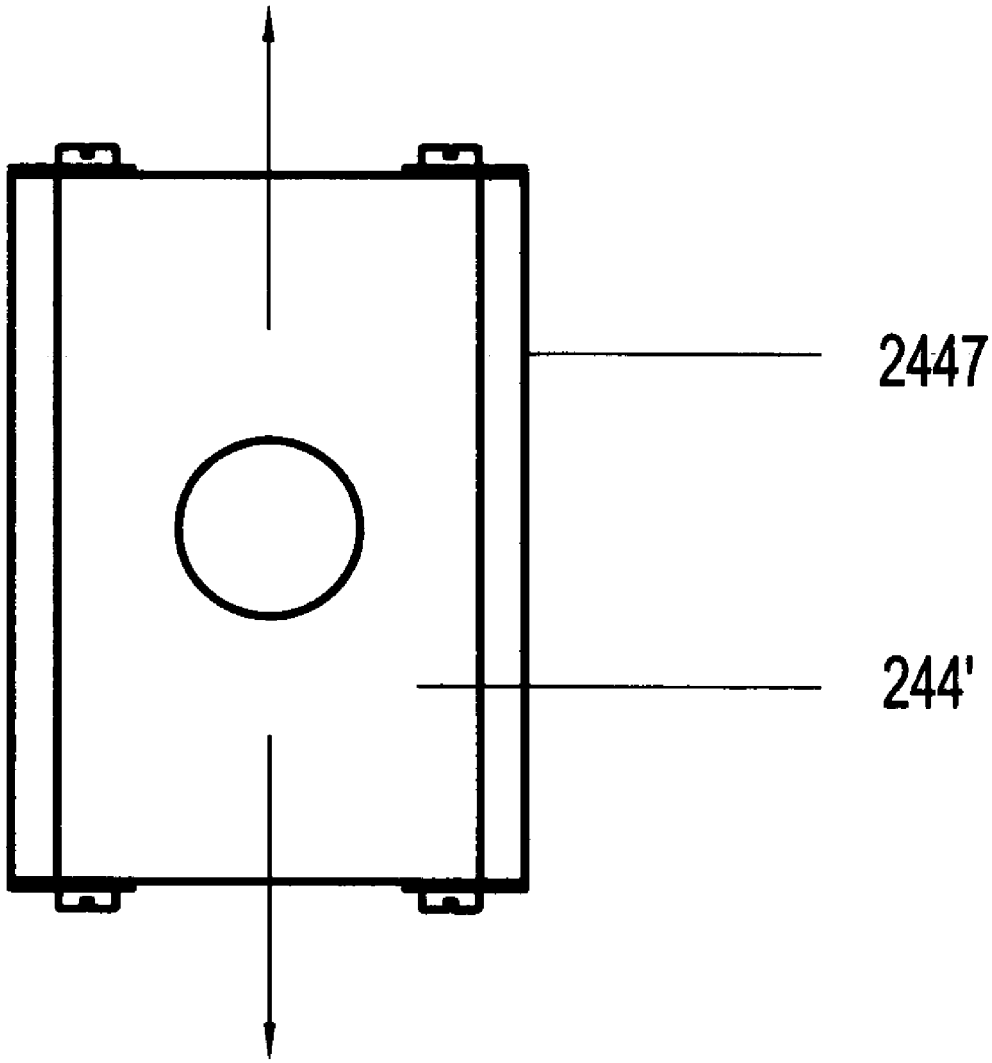
FIG. 9*b* is another view of the structure of the main shaft control device in FIG. 8.

The main shaft control device 244 may also employ any other structure. FIG. 9B shows an adjustable main shaft control device 244'. Different to FIG. 9A, the sides of the main shaft control device 244' are smooth iron sheets 2447, which are adjustable to adapt to the rails.

In this invention, the main shaft control device 244 is designed as a sliding block, the outer diameter of which is identical to the inner diameter of the small rails 241; thus the main shaft control device 244 can slide in the small rails 241 and keep the main shaft of the motor 245 stationary.

Dust Absorption and Safety Protection

A great deal of dust will occur when you polish wall with the polisher. A large part of the dust flies in the original direction and then spread quickly under air resistance; some of the dust clings to sandstone disk 251 and flies out along with the rotation of the sandstone disk 251, and then hits the polishing surface and flies about; some of the dust will stick to the polished wall face and should be cleared, otherwise it will degrade the viscous force of the paint and result in peeling-off.

In view of above issue, the protection hood 253 is accompanied with a dust collecting device, i.e., a dust absorption mouth 2534 is mounted on the protection hood 253, as shown in FIG. 10; said dust absorption mouth 2534 comprises an air inlet 2531, a chamber 2532, and hose outlets 2533; said dust absorption mouth is a flat mouth, and it length is equal to the length of the sandstone disk 251; the chamber 2532 is relatively larger and may be connected to several flat mouths simultaneously. The dust created during polishing work enters into the chamber 2532 via the air inlet 2531 and rotate in the chamber 2532; under the wind power at both sides in the chamber, the dust is driven into the hoses at both sides via the hose outlets 2533, and then enter into the dust bag of the dust collecting device.

The following factors shall be taken into consideration when the dust absorption mouth 2534 is mounted: first, the dust absorption mouth shall be near the position where the dust is created (under the sandstone cylinder) as much as possible; second, the dust absorption direction shall be in the dust flying path; third, the area of the dust inlet under the sandstone cylinder should be small so that air flow can occur there to suck in the dust, the space above the sandstone cylinder should be big enough and covered with a wind shield to reduce flying speed of dust and facilitate dust absorption. The three important dust absorption positions are (in order): under the sandstone disk, dust flying point above the sandstone disk; above the sandstone disk.

Figure 11:
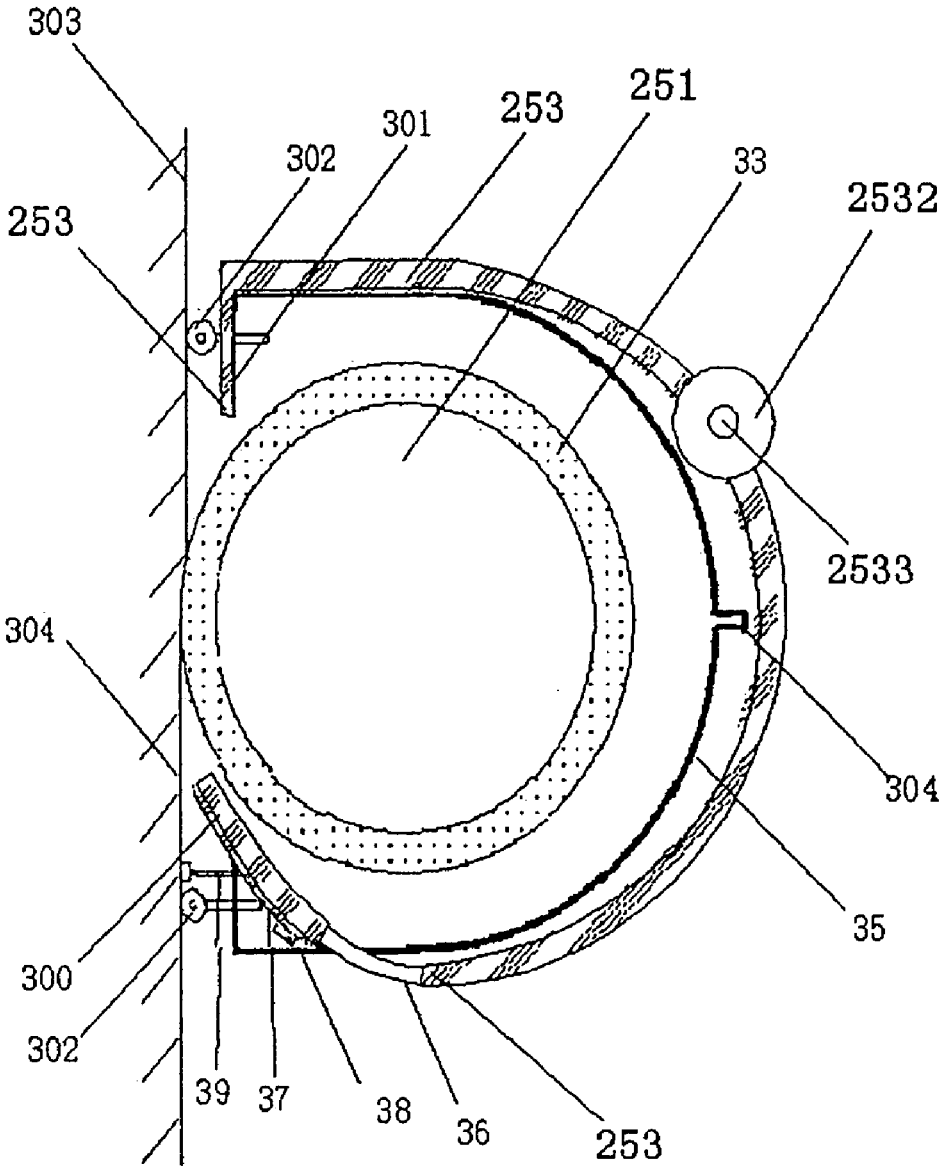
FIG. 11 is a sectional view of the assembly of sandstone disk protection hood and dust absorption mouth of the polisher in this invention.

According to the actual situation of dust out-fly, the sandstone disk protection hood 253 is designed as a safety protection hood that can collect dust in several grades, as shown in FIG. 11. In detail, the bottom of the safety protection hood 253 is a baffle plate 37 that may be adjusted with 38; a soft gum annular dust pipe 300 is fixed in the baffle plate 37 and it is connected to the air intake mouth 2531 through a communication pipe 36; the baffle plate 37 may be adjusted so that the annular dust pipe 300 is near the polish surface as much as possible to reduce the distance between the sandstone cylinder and the working surface, in order to form strong air flow to suck in dust; the baffle plate 37 may be adjusted as required so that sand will drop onto the ground but dust will enter into the safety protection hood; a small brush 39 may be mounted on the baffle plate of the safety protection hood to brush off dust sticking to the wall; when dust falls off, lighter dust is taken into the safety protection hood, but heavier dust fall onto the ground; in addition, another mouth 2531 may be mounted on top of the safety protection hood and it is connected to the air intake mouth 2534; said mouth 2531 may suck in dust flying from the sandstone disk; furthermore, the mouth 2531 may be near the sandstone cylinder as much as possible to take dust in the sandstone disk; a baffle plate 301 may be mounted in the safety protection hood to reduce flying speed of dust and enhance the dust absorption effect at the air intake mouth 2531. Dust sucked into above 3 air intake mouths 2531 will enter into a chamber and then into the hoses 300. To enhance dust absorption effect, the safety protection hood may be wrapped with a gum cover to increase air tightness.

See FIG. 1C, wherein an air outlet may be mounted at rear-end of the protection hood 253 (according to air tunnel principle, a small motor may also be added to enhance dust absorption effect); said air outlet is connected to a flexible rubber hose, which is connected to the dust collector 405.

See FIG. 6, wherein there are small positioning pulleys 258 fixed on the protection hood 253 and bearings mounted on both sides of the protection hood 253; said bearings are fitted on the shafts so that the safety protection hood can turn along the uneven wall face and the positioning effect of the positioning pulleys are maximized.

Positioning/Limiting Device

In this invention, the clearance between the sandstone disk and the polishing surface may be limited with the small pulleys mounted on the protection hood 253 or the bearing baffle plate 257. The polishing depth of the sandstone disk 251 may be adjusted to attain positioned polishing effect; in addition, the positioning area is relatively small through that positioning method, thus both the workload and work difficulty will be reduced.

The clearance between the fixing part 1 and the polish surface may be limited through mounting 2 positioning/limiting rods 19 (see FIG. 1) at the edge of top plate 12 of the fixing plate 1 or top of front upright post 13. Such a positioning method is ideal for positioning larger area.

In case the gradient of the polishing surface is high, positioning threaded rods 28 may be mounted on top of slide rails 24 (see FIG. 1); the polishing accuracy may be adjusted through adjusting the positioning threaded rods; though that method is ideal for positioned polishing, the workload is huge.

Above positioning/limiting methods may be used in combination to achieve self-leveling function of the polisher.

Circuit Control Part

Figure 12:
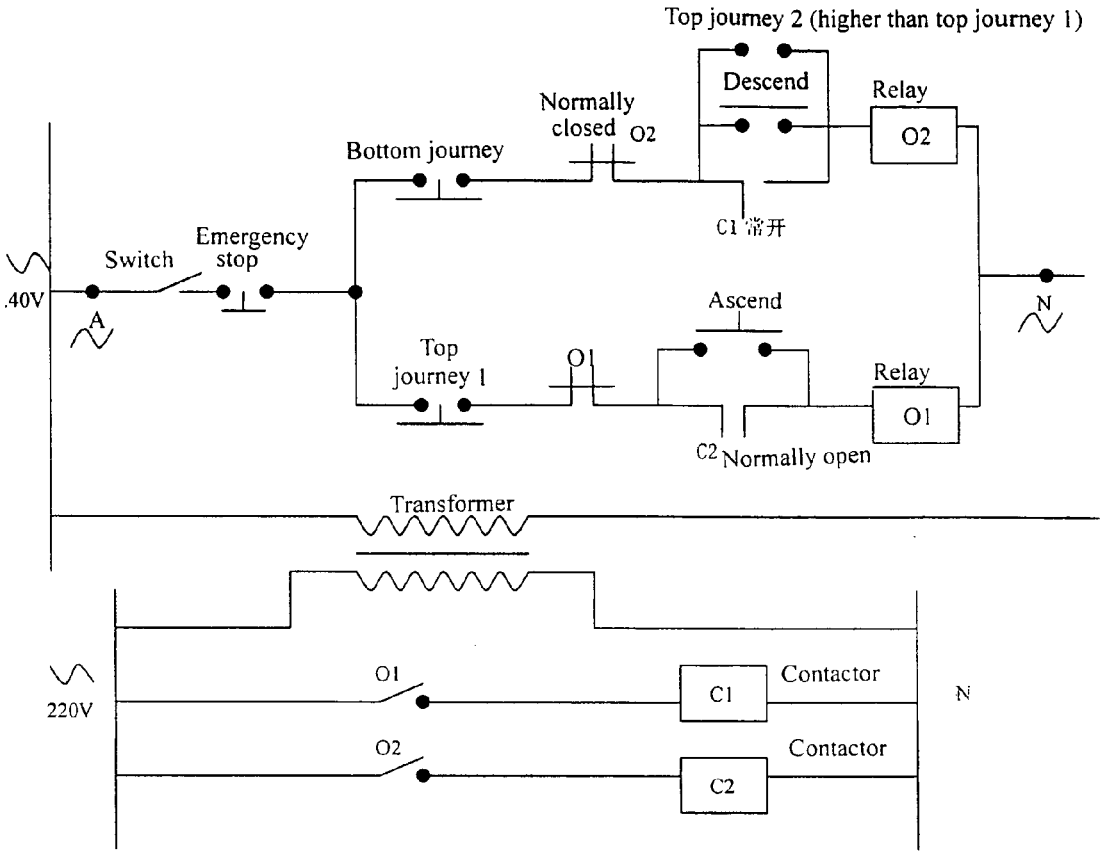
FIG. 12 is a circuit control diagram of the motor in this invention.
Figure 12B:
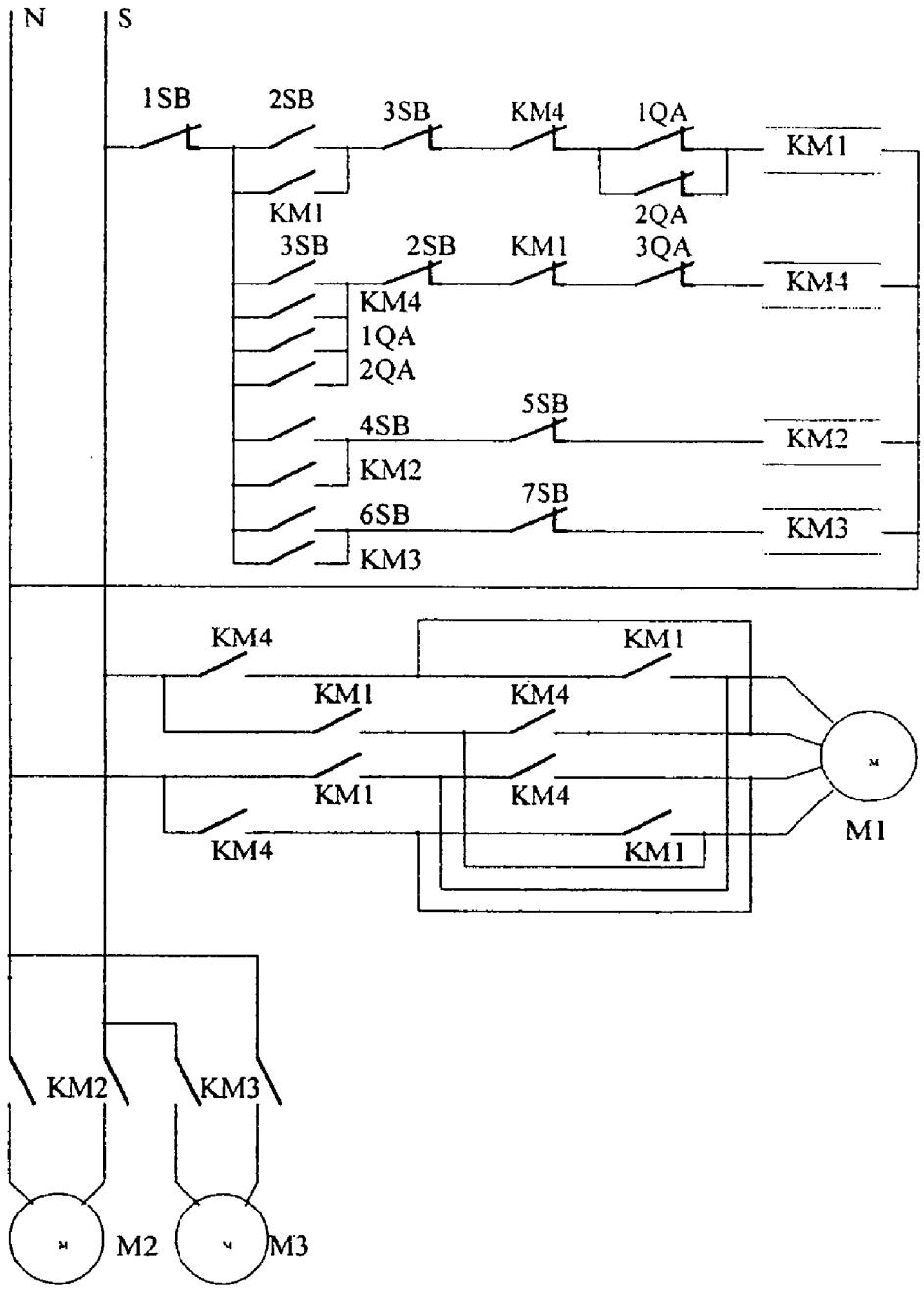
FIG. 12B is a circuit control diagram of the other motor in this invention.

To simplify the operation, a travel switch may be used. when the travel switch is triggered, the lifting motor will rotate and the polisher will rise up; when the polisher reaches to the top of the wall, the lifting motor will rotate in the reversed direction, thus the polisher will go down; when the polisher reaches to the bottom, the lifting motor will stop; when the motor is started again, the polisher will rise up again; in case a certain position on the wall face is to be repaired, the polisher may be moved to that position manually; the operation part may utilize safety voltage. FIG. 12 and FIG. 12B show the circuit control diagram.

Instruction to the symbols in FIG. 12B:

| | | |
|---|---|---|
| 1SB | Master stop button | LA1 |
| 2SB | Polishing head rising control button | LA1 |
| 3SB | Polishing head dropping control button | LA1 |
| 4SB | "Dust collector on" button | LA1 |
| 5SB | "Dust collector off" button | LA1 |
| 6SB | "polishing head on" button | LA1 |
| 7SB | "polishing head off" button | LA1 |
| 1QA, 2QA | Top travel switch | JLXK1 |

-continued

| | | |
|---|---|---|
| 3QA | Bottom travel switch | JLXK1 |
| KM1, KM4 | AC contactor | CJX2-123(with auxiliary contact) |
| KM2, KM3 | AC contactor | CJ10-5 or CJ20-10 |
| M1 | Climbing control motor | YcJT-90-1/4 (with decelerator) |
| M2 | Motor of dust collector | |
| M3 | Motor of polishing head | |

The circuit can control the polishing head to ascend and descend as well as ascending/descending switching action with the travel switch; it can control the polishing head and the dust collector to start/stop.

Implementation:

(1) Under normal condition (power on), when the "6SB" button is pressed down, the polishing head will start working; when the "2SB" button is pressed down, the polishing head will climb up under the drive of the lifting motor.

(2) When the entire support rises to the top position or the top of the support touches the ceiling, under the action of 1QA and 2QA, the lifting motor rotates in reverse direction, thus the polishing head will descend.

(3) When the polishing head reaches to the bottom, the lifting motor will stop under the action of 3QA. Then the polishing head stops at the bottom position.

(4) When the "5SB" button is pressed down, the dust collector will be started to absorb dust created during polishing work.

(5) When the "1SB" button is pressed down, the machine will stop.

(6) When "2SB" or "3SB" is pressed down during the polishing head moves, the moving direction of the polishing head will be reversed to meet special requirements during the polishing work.

(7) "5SB" and "7SB" control the polishing head and the dust collector independently. In case the dust is not severe, the dust collector may be stopped.

(8) The entire circuit is installed in a electric control cabinet and the machine is controlled with a contactor; thus it can ensure personnel safety and prevent electric shock effectively.

Mini Polisher

Figure 13:
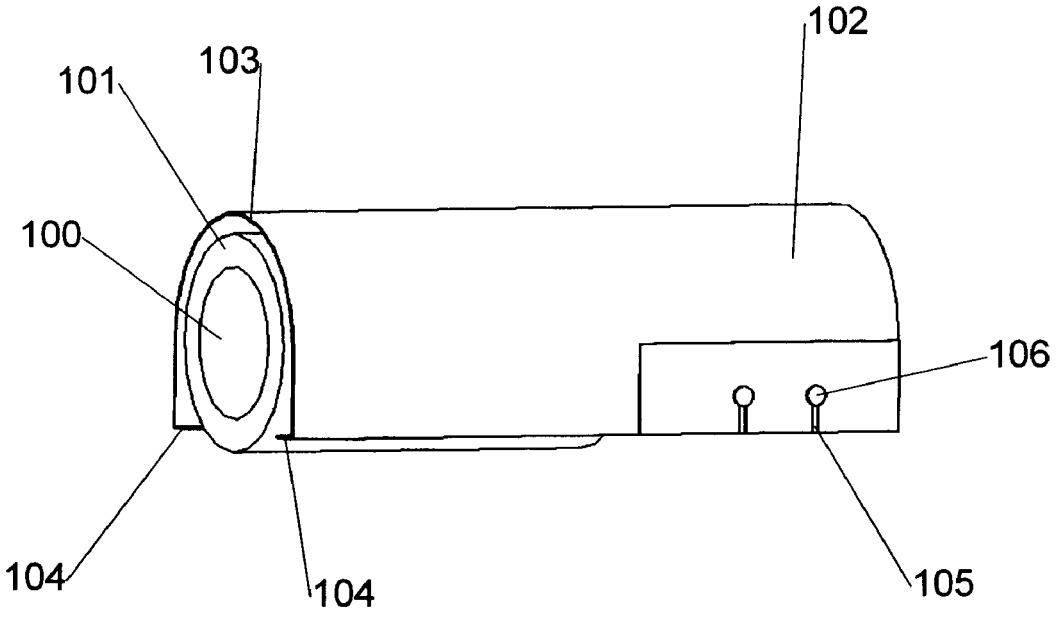
FIG. 13 is a 3D effect diagram of the mini polisher (without protection hood) in this invention.
Figure 14:
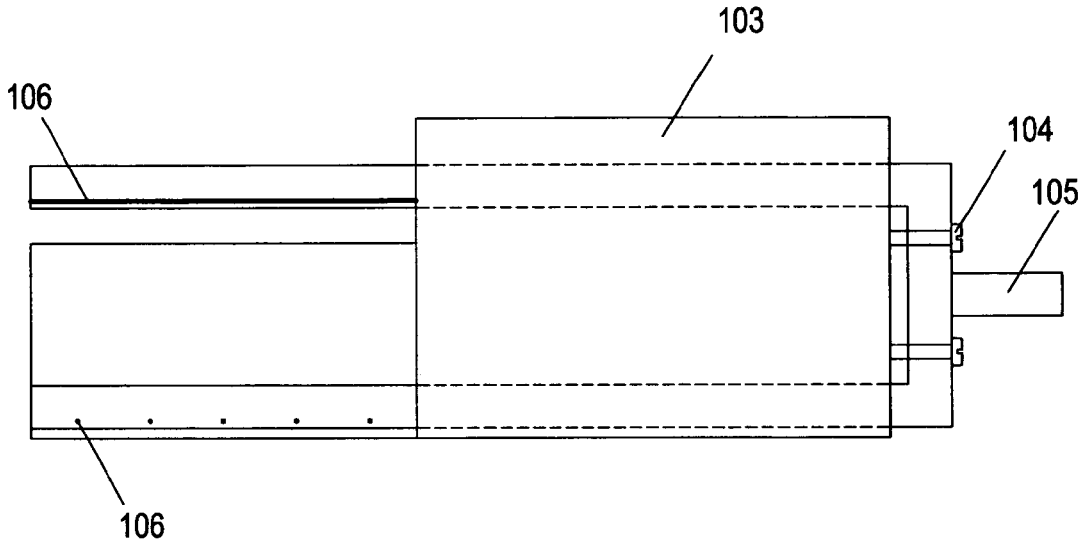
FIG. 14 is a schematic diagram of the mini polisher in this invention.
Figure 15:
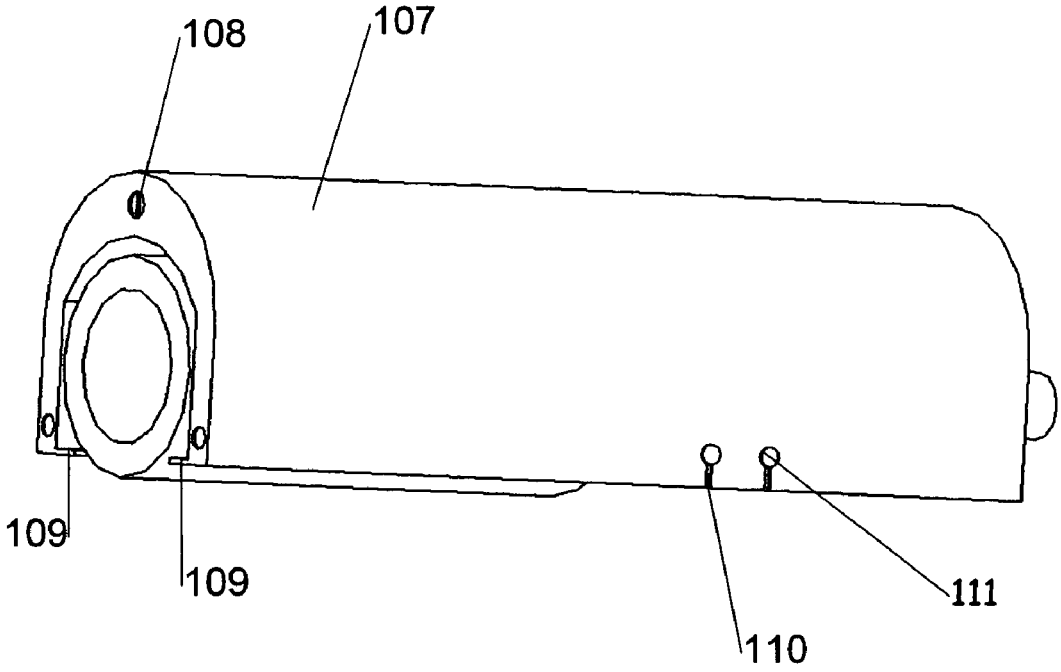
FIG. 15 is a 3D effect diagram of the mini polisher in this invention.

Above polisher in this invention is relatively huge and inconvenient to polish wall corners. For this reason, this invention provides another handheld mini polisher, as shown in FIG. 13~15; said mini polisher comprises 2 parts: polishing sandstone cylinder 100, and motor 101 and safety protection hood 107; said safety protection hood 107 has a positioning surface 109 at the bottom, adjusting channels 110, and nuts 111; the sandstone cylinder 100 is protected with the safety protection hood 107 and is fixed on the motor 101; there is a hole under the safety protection hood 107; the sandstone cylinder may protrude a little through adjusting the channels 110 and nuts 111; there are 2 positioning surfaces 109 at sides under the sandstone cylinder; the machine can detect a plane to proceed polishing work with those positioning surfaces 109; the safety protection hood 107 also wraps the motor 101 to form a handheld polishing bar; the surfaces 109 under the safety protection hood 107 achieve positioning effect; through adjusting the safety protection hood 107 with the channels 110 and the nuts 111, the sandstone cylinder 100 may protrude a little to polish walls, so that the polishing depth may be adjusted.

The dust absorption part of the mini polisher is designed as follows: a small iron tube is fixed on the motor 101 and comprises two portions: the portion extruding from the sandstone cylinder 100 is called "dust pipe" 102, and the portion fixed onto the motor is called "air feeder" 103; there is an air flow control switch at the back end of the air feeder 103; the air feeders are combined into an air outlet 105, which is connected to a hose, a force fan, and the bag of the force fan to achieve dust collection; the dust pipe 102 is outside of the safety protection hood; there is a groove 106 (or a hole) in the safety protection hood (dust pipe 102) to facilitate dust and sand to enter into the dust pipe 102.

The mini polisher is small and can be held by hand; it is ideal for wall corner polishing work.

INDUSTRIAL APPLICABILITY

This invention has the following benefits:

1. Due to the utilization of rail assembly and the position difference correction rail, the polisher in this invention is applicable to different rooms and external walls; due to the design of cross section of the rails and the application of the slide plates, equipment shock is reduced significantly and the stability is enhanced.
2. The guide sleeve can prevent excessive friction during sliding action and avoid excessive tilting of the support plate during the polishing work.
3. The polisher in this invention achieves self-leveling function with the built-in spring in the sliding block.
4. High dust absorption efficiency grants application feasibility of the machine.
5. Combined utilization of the threaded rod positioning system and the pulley positioning system on sandstone disk protection hood increase the application value of the machine.
6. The handheld mini polisher is a complement to the big machine.

In view of above benefits, the wall polisher in this invention can be used widely in wall polishing work and has high industrial applicability.

What is claimed is:

1. A wall or roof polisher comprising a lifting platform and a polishing unit installed on said lifting platform wherein said polisher is featured with: said lifting platform is a fixed part comprising a seat, a top plate, several upright post parallel to each other between the seat and the top plate, and moving pulleys under the seat; said polishing unit is a sliding part comprising an upper support plate, a lower support plate, a polishing cylinder; and 2 support posts and 2 slide rails mounted in parallel between said support plates; said 2 support posts of said polishing unit pass through the top plate of said fixed part.

2. The wall or roof polisher as in claim 1, wherein said polisher is featured with: a motor is mounted on said lifting platform to drive the polishing unit; said polishing unit comprises a polishing cylinder, a protection hood that is outside of said polishing cylinder and may turn 90°, and a motor that drives the polishing cylinder.

3. The wall or roof polisher as in claim 2, wherein said polisher is featured with: positioning pulleys are mounted in the notch direction of said protection hood.

4. The wall or roof polisher as in claim 3, wherein said polisher is featured with: positioning/limiting poles are mounted at edge and/or top of the underplate of said lifting platform.

5. The wall or roof polisher as in claim 4, wherein said polisher is featured with: there is a bearing baffle plate at each side of said polishing cylinder; a sliding block is mounted at outer side of each bearing baffle plate; said sliding blocks are in said slide rails and can slide in said slide rails; there are springs in said sliding blocks.

6. The wall or roof polisher as in claim 5, wherein said polisher is featured with: said polishing cylinder is a sandstone disk/sandpaper cylinder or a metal cylinder; said sandpaper cylinder is a elastic mass.

7. The wall or roof polisher as in claim 6, wherein said polisher is featured with: said elastic mass is a cylinder formed through covering a elastic gum on a bushing or pulling a plurality of springs between the fixing disks of a cylinder; there are a plurality of iron rings fixed to the springs in said cylinder.

8. The wall or roof polisher as in claim 4, wherein said polisher is featured with: said polishing cylinder is a sandstone disk/sandpaper cylinder or a metal cylinder; said sandpaper cylinder is a elastic mass.

9. The wall or roof polisher as in claim 1, wherein said polisher is featured with: there are pulleys mounted under upper support plate of said polishing unit: two lifting pulleys are at the sides, two deflecting pulleys are in the middle, and another lifting pulleys is between the two deflecting pulleys; two lifting pulleys are mounted under the top plate of said fixed part; a lifting pulley is mounted on the lower support plate of said sliding part; two steel ropes are suspended at ends of the sandstone disk frame, and said steel ropes pass through said a plurality of pulleys and enter into cable rollers at sides of the motor on the seat; the sandstone disk frame is driven by the motor on the seat to slide in the slide rails and the sliding part slides along the posts of said fixed part.

* * * * *